United States Patent [19]

Teruo et al.

[11] Patent Number: 4,646,609

[45] Date of Patent: Mar. 3, 1987

[54] DATA INPUT APPARATUS

[75] Inventors: Hiyoshi Teruo; Mizuno Koutaro; Yamada Shigeru, all of Hamamatsu, Japan

[73] Assignee: Nippon Gakki Seizo Kabushiki Kaisha, Hamamtsu, Japan

[21] Appl. No.: 736,216

[22] Filed: May 20, 1985

[30] Foreign Application Priority Data

May 21, 1984 [JP] Japan ..... 59-102425
Jun. 30, 1984 [JP] Japan ..... 59-135881

[51] Int. Cl.[4] ..... G10H 1/00

[52] U.S. Cl. ..... 84/1.01; 84/1.03; 84/DIG. 7

[58] Field of Search ..... 84/1.01, 1.03, DIG. 7

[56] References Cited

U.S. PATENT DOCUMENTS 3,624,583 11/1971 Nakada ..... 84/DIG. 7
3,699,492 10/1972 Yoshihara ..... 84/DIG. 7
4,448,104 5/1984 Hoshii ..... 84/1.03
4,499,807 2/1985 Ishida ..... 84/1.03
4,539,882 9/1985 Yuzawa ..... 84/1.03

*Primary Examiner*—Russell E. Adams
*Attorney, Agent, or Firm*—Spensley Horn Jubas & Lubitz

[57] ABSTRACT

A data input apparatus comprises an operation panel; a plurality of input keys arranged on the operation panel; and a fine adjusting bar arranged on the operation panel; and a data generator coupled to the input keys and to the fine adjusting bar. Each of the input keys designates a coarse selection of an input instruction, respectively, from among a plurality of input instructions such as musical note pitches and durations. The fine adjusting bar designates a fine adjustment for and in common to the respective selected input instructions designated by the input keys. The data generator generates data bearing information formed by the selected input instruction and the fine adjustment. Thus the data input apparatus composes musical performance data for automatic performance by musical tones with adjusted note pitches, note durations, and other note characters.

18 Claims, 17 Drawing Figures

268

270

DATA INPUT APPARATUS

BACKGROUND OF THE INVENTION (a) Field of the Invention

The present invention relates to a data input apparatus suitable for use in, for example, an automatic music performing machine.

(b) Description of the Prior Art

In the past, in order to input musical data such as note pitches and note durations into, for example, an automatic music performing machine, a keyboard resembling that of a typewriter was adapted so that keys thereof are depressed to designate desired note names, note durations and like musical items, and in accordance with these designated note names, note durations and like musical items, musical data was composed and stored in a memory. However, according to such a known designating and storing system, while it is possible to designate note names, note durations and like musical items, it has not been possible to add various fine adjustments of, for example, note pitch (note frequency), note duration (time length) and like items, or to set various note characters (tone properties) relating to timbre, loudness, effect and the like. Hence there has been the drawback in such prior art systems that the performance played by an automatic music performing machine tended to be monotonous. Thus, in order to make possible the inputting of various additional data such as those mentioned above, it has been necessary to provide a very large number of additional keys which, in turn, has led to the disadvantages represented by complication in the arrangement of the operation panel and also in the data-inputting operation. Moreover, note pitch designating keys and note duration designating keys are congestively arrayed on the operation panel, so that an unskilled operator requires substantial time to locate the necessary keys which are to be depressed, and thus it has been difficult to efficiently accomplish an input operation.

SUMMARY OF THE INVENTION

It is, therefore, an object of the present invention to provide a data input apparatus which, with the provision of a relatively small number of keys on an operation panel, enables its operator to make an input instructions including designation of note names, note duration and like items, various fine adjustments concerning note pitch, sounding time length and like items, and also various note characteristics concerning timbre, loudness, effect and so forth. This object is achieved by a data input apparatus comprising: an operation panel; a plurality of course selection-designating means arranged on said operation panel each designating a coarse selection of an input instruction, respectively, from among a plurality of input instructions; a fine adjustment designating means common to the plurality of course selection-designating means arranged on said operation panel for designating a fine adjustment for and in common to the respectively selected input instructions designated by the course selection-designating means; and a data generating means coupled to said course selection-designating means and to said fine adjustment designating means for generating data bearing information formed by said selected input instruction in combination with said fine adjustment.

Another object of the present invention is to provide a data input apparatus which enables an unskilled operator to easily and accurately accomplish a data input operation. This latter object is achieved by a data input apparatus comprising: an operation panel; a plurality of note pitch designating keys arranged on a right half of said operation panel for selectively designating course note pitches; a plurality of note duration designating keys arranged on a left half of said operation panel for selectively designating course note durations; note pitch data generating means coupled to said note pitch designating keys for generating data representing the designated course note pitch; and note duration data generating means coupled to said note duration designating keys for generating data representing the designated course note duration.

According to the present invention, the data input apparatus is constructed so that, for an initial coarse selection which is designated by operating one of the respective designating means, there is automatically effected a designation of a course selection fine adjustment thereof by operating a single fine adjustment designating means common to the plurality of course selection-designating means. Therefore, the operator is able to make an input operation which includes designation of such items as note name, note duration and so forth, while easily adding various fine adjustments concerning note pitch, sounding and like fine items, and also setting of various note characters relating to timbre, loudness, effect and like items, just by manipulating the relatively few course selection keys in conjunction with the common fine adjustment means provided on the operation panel. Therefore, in case, for example, a note pitch data is to be inputted, it is possible to designate tone names such as "Do", "Re", "Mi", etc. by operating course selection-designating means and also to designate fine adjustment of note pitch of the note name thus designated, by operating and in conjunction therewith a fine designating means common to the plurality of course selection-designating means, and further possible to generate, by operating a data generating means, a data which is representative of the note pitch determined in accordance with the note name selection and with the note pitch fine adjustment made as above. Also, in case it is intended to input a note duration data, it is possible to designate, by operating the course selection-designating means, note durations such as "whole note", "half note" and "quarter note", and to designate in conjunction therewith, by operating the fine adjustment designating means, a fine adjustment of the time length of the designated note duration, and further to generate, by a data generating means, a data indicative of the time length determined in accordance with the said note duration selection and also with the said time length fine adjustment. Further, in case a note characteristic (attribute) control data is to be inputted, it is possible to designate, by operating the course selection-designating means, note characteristic control items such as timbre, loudness, effect, tempo, etc., and to designate in conjunction therewith, by operating the fine designating means, a respective fine adjustment of the note characteristics of the designated note characteristic control items, and also to generate, by operating the data generating means, a data representative of the note characteristics determined in accordance with the note characteristics control item selection and with said note characteristic fine adjustment which was determined by the above course and fine adjustment operations.

It should be understood here further that the course selection-designating means comprises input keys provided respectively to a plurality of categories and degrees of any given input instruction, and the fine designating means comprises a touch bar which is used in common to all course selection input keys, so that, unlike the complicated arrangement of the described prior art systems, it is enough to just touch this single common fine adjustment bar for effecting the final setting of various fine adjustments to the musical attribute already selected by the depression of the intended course selection-designating keys. Thus, a substantial number of keys can now be eliminated from the surface of the operation panel, thus simplifying both the operation panel arrangement as well as the input operation. Furthermore, display means which, preferably, are bar-shaped indicators are arranged in parallel with the touch bar to indicate the amounts of the intended respective adjustments, and this visual feedback enhances both the accuracy and ease of accomplishment of the input operation.

In case the data input apparatus according to the present invention is used as an input means of an automatic music performing machine, this data input apparatus is able to input multifarious performing data, and accordingly there are obtained automatic performances which are rich in variation. More specifically, with respect to note pitch data, it is possible to impart them with a subtle shift of note pitch for each note by the operation of the fine adjustment touch bar. Thus it becomes also possible, if desired, to set a tune which is to be played, on the basis of a musical scale of just-intonation. Likewise, for a note duration data, it is possible to accomplish a fine adjustment of the length for each note by an operation of the touch bar, whereby it is possible to realize a performance such as staccato playing and legato playing. Furthermore, for a note character control data, it is possible to achieve a fine adjustment of timbre, loudness, effect, tempo or the like by an operation of the touch bar, and thus there can be accomplished an automatic performance which faithfully reflects the intention of the operator.

Also, according to the present invention, a plurality of note pitch designating keys are disposed on the right half region of the operation panel, and a plurality of note duration designating keys and arranged on the left half region of the operation panel. The operator manipulates note pitch designating keys by the fingers of his right hand, while he operates note duration designating keys by the fingers of his left hand, and thus he is able to make an input operation efficiently. Furthermore, the note pitch designating keys are arranged in the order of fingering allotment of the musical scale notes, so that the input operation for designating note pitches becomes more simplified than before. Also, the note duration designating keys are formed to bear the shapes of musical notations of respective note durations, and this makes the input operation of designating note duration much simpler.

These and other objects of the present invention will become more apparent during the course of the following detailed description and the appended claims.

DETAILED DESCRIPTION OF THE PREFERRED EMBODIMENTS

The present invention will hereunder be described in further detail based on the exemplary embodiments in conjunction with the accompanying drawings.

EMBODIMENT

Operation panel arrangement

Figure 1:
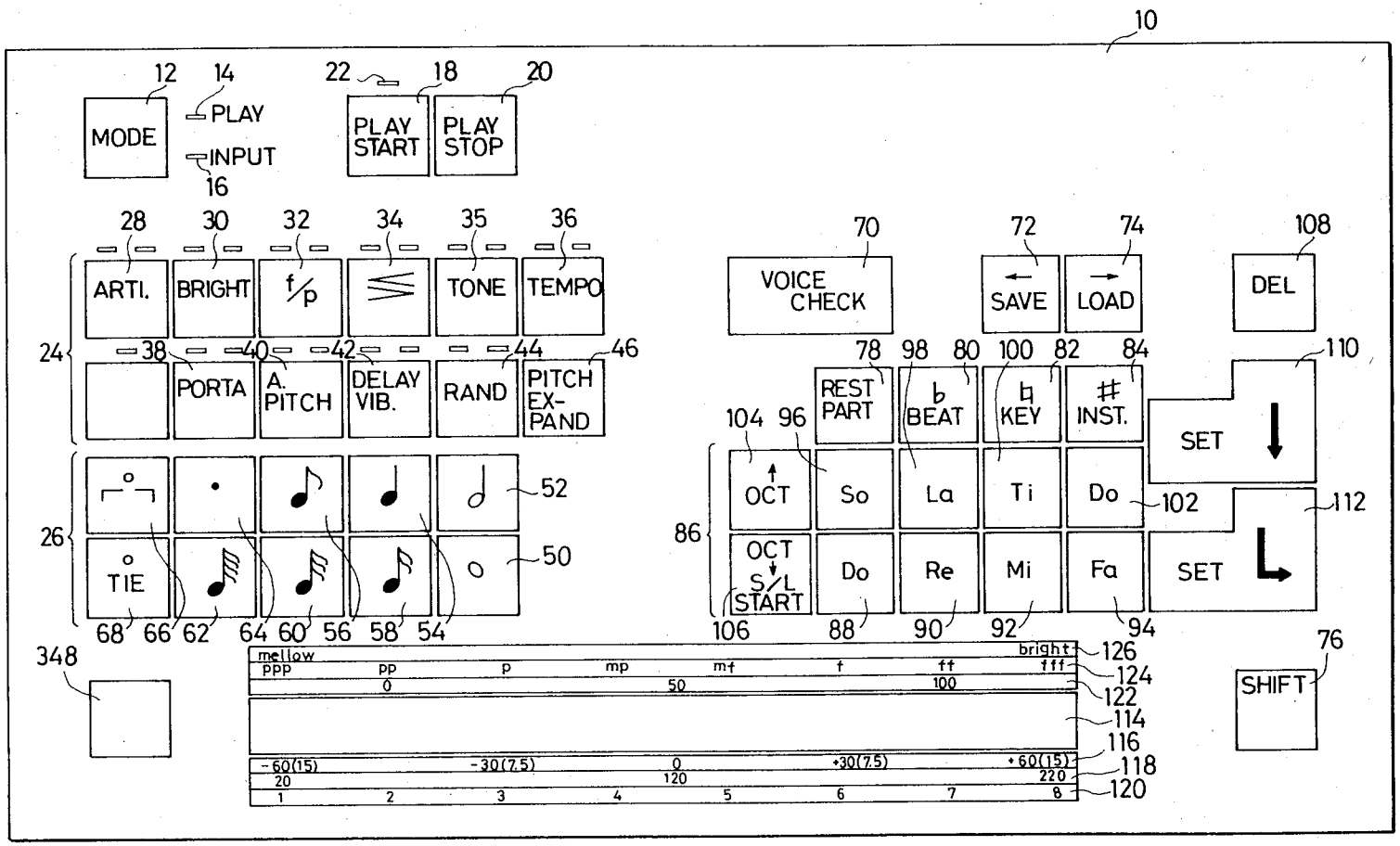
FIG. 1 is a diagrammatic plan view of the operation panel of an embodiment of the musical data input apparatus according to the present invention.

FIG. 1 shows the arrangement of the operation panel of the musical data input apparatus according to an embodiment of the present invention.

In the left half region of the operation panel 10, a mode designating key 12 is provided to designate either the PLAY mode or the INPUT mode. In the vicinity of this key 12, there are provided a light-emitting device 14 for indicating the PLAY mode and also another light-emitting device 16 for indicating the INPUT mode. If the light-emitting device 14 is lit to indicate the PLAY mode is on and the mode designating key 12 is depressed, then the INPUT mode will be designated. As a result, the light-emitting device 14 goes out, and concurrently therewith the light-emitting device 16 lights up. Simularly, if the mode designating key 12 is depressed while the light-emitting device 16 is illuminated, indicating that the INPUT mode is on, the machine will toggle into the PLAY mode. As a result, the light-emitting device 16 will shut off while the light-emitting device 14 indicating the PLAY mode, will light up. It should be understood here that the PLAY mode is provided for realizing an automatic performance by the automatic performing machine which will be described later, and that the INPUT mode is one for inputting, into the automatic performing machine, a musical data (play data) intended for automatic playing.

On the right side of the mode designating key 12, there are provided a play start key 18 and a play stop key 20 in a side-by-side fashion. The play start key 18 is depressed to initiate automatic playing at the time the machine is in the PLAY mode. Upon turning this key 18 on, a light-emitting device 22 which is provided in its vicinity is illuminated to indicate that a musical score is being played. The play stop key 20 is depressed automatically whenever it is intended to stop the automatic performance.

Below the row of keys 12, 18 and 20, there is provided a group 24 of attribute select keys for designating note characteristic control items, and another group 26 of duration keys for designating note durations.

In the group 24 of attribute select keys, an input key 28 is intended to make possible a desired sub-timbre (i.e. articulation) setting for each typical timbre of musical instruments such as flute or organ; and if the instrument is organ, the operator is able to set the sub-timbre in the style of a church organ if it is his favorite style. An input key 30 is intended for making possible the setting of the degree of tone quality either for mellow or bright for any timbre which is peculiar to each type of musical instrument set in the apparatus. An input key 32 is for allowing the setting of the tone intensity (loudness) such as forte (f), piano (p), etc. for each note. An input key 34 is intended to make possible the setting of loudness variation pattern such as crescendo and decrescendo (diminuendo) in connection with sequentially aligned notes. An input key 35 is for making possible the setting of tone quality variation pattern with time for either mellow or bright in connection with the successively arranged notes. An input key 36 is for permitting the setting of tempo of a tune. An input key 38 is for making possible the setting of the degree of portamento effect. An input key 40 is for allowing the setting of the degree of attack pitch effect. An input key 42 is for enabling the setting of the degree of delay vibrato effect. An input key 44 is for making possible the setting of the degree of random (i.e. trembling or fluctuating) effect. An input key 46 makes possible an alteration of the scope in which a pitch adjustment is allowed for each timbre.

In the group 26 of input keys, duration keys 50, 52, 54, 56, 58, 60 and 62 are intended to designate whole note, half note, quarter note, eighth note, sixteenth note, thirty-second note and sixty-fourth note, respectively; whereas an input key 64 is for designating a dot (50% addition); an input key 66 is for designating grouping; and an input key 68 is for designating a tie.

In the right half region of the operation panel 10, a voice check key 70 is provided to confirm, for each note, the state in which such items as note pitch, timbre, loudness and effect have been set. The machine is designed so that, upon this key 70 being turned on, the note corresponding to the state of setting is sounded out.

Keys 72 and 74 which are provided side-by-side on the right side of the key 70 are assigned to exert two-way functions in accordance with the presence or absence of operation of a shift key 76 which is provided at the lower right region of the panel. More particularly, in the state that the shift key 76 is not turned on (not depressed), both keys 72 and 74 will serve as cursor control keys for moving the cursor on a CRT display face. When the key 72 is turned on, in the unshifted mode, the cursor moves toward the left, and by turning the key 74 on, the cursor will move toward the right. In such a case, by intensifying the depressing force applied to either the key 72 or the key 74, the cursor will move with a greater speed accordingly. Also, when the shift key 76 is turned on, the keys 72 and 74 will now be actuated to function as a save mode designating key and a load mode designating key, respectively. Thus, by turning the key 72 on with the shift key activated, it becomes possible for the operator to enter the save mode operation for reading out a play data from a tune data memory (which will be described later) and recording this data on a floppy disk. On the other hand, if the key 74 is turned on with the shift key activated, this operation makes it possible to enter the load mode operation for reading in a play data from the floppy disk and writing the play data into the tune data memory.

Below the array of keys 70, 72 and 74, there are arrayed four input keys 78, 80, 82 and 84 in a side-by-side arrangement. These four input keys are adapted to exert two-way functions in accordance with the presence or absence of operation of the shift key 76. More specifically, in the state that the shift key 76 is not operated, the key 78 will function as the key for designating "rest", the key 80 as a key for designating "flat", the key 82 as the key for designating "natural", and the key 84 as the key for designating "sharp". When the shift key 76 is turned on, the key 78 will function as the key for designating "part number", the key 80 as the key for designating "meter" beat, the key 82 as the key for designating "tonality" (key), and the key 84 as the key for designating "musical instrument timbre" (inst). It should be noted here that the designation of "rest" duration can be realized only by turning-on the input key 78 using the operator's right hand and simultaneously turning-on a desired key among the duration keys 50 to 64 using the operator's left hand.

Below the array of keys 78 to 84, there is provided a group 86 of pitch keys for note pitch designation. In this group 86 of pitch keys, input keys 88, 90, 92, 94, 96, 98, 100 and 102 are intended to designate the note names Do($C_4$), Re($D_4$), Mi($E_4$), Fe($F_4$), So($G_4$), La($A_4$), Ti($B_4$) and Do($C_5$), respectively. Also, an input key 104 of the group is intended to shift the pitch upward by one octave at a time for each depressing of this input key 104. An input key 106 of the group is intended to shift the pitch downward by one octave at a time for each depression of this key. By conducting octave-shifting by using the input keys 104 and 106, it is possible to designate tone pitches corresponding to any arbitrary note from the group of notes $C_1$ to $B_8$.

The input keys 94 and 106, when shift key 76 is turned on, will function as an insert mode designating key and a save/load (S/L) start key, respectively. When the insert mode is designated by the key 94, it becomes possible to insert, for example, a desired note at a desired place in a note arrangement displayed on a CRT display face at the position corresponding to the location of cursor. Also, when the key 106 is turned on at the time that the save mode has been designated by the keys 72 and 76, the operation of the save mode is started. Further when the key 106 is turned on at the time the load mode has been designated by the keys 74 and 76, the operation of the load mode is started.

On the right side of the group 86 of pitch keys, there are provided a delete key 108, a first setting key 110 and a second setting key 112 as viewed from top to bottom of the operation panel 10.

The delete key 108 is intended to delete, for example, a note which is positioned at the location of the cursor on the CRT display face. Also, the first and second setting keys 110 and 112 are depressed to deliver an input instruction at the time of making an editing change which will be described later. More particularly, by turning the first setting key 110 on, the notes which are inputted subsequent to a first note will be entered in the same instant beat of this first note to constitute a chord, whereas when the second setting key 112 is turned on, the note which will be inputted next will be entered in the next adjacent beat. It should be noted here that the second setting key 112 is used to deliver an input instruction also at the time of an initial input which will be described later.

On the operation panel 10, below the abovementioned arrays of various keys, there is provided an elongated touch bar 114 extending so as to bridge substantially the left one half region and substantially the right half region of these key arrangements. This touch bar 114 is for use in common with the groups 24, 26 and 86 of input keys in such a manner that, in connection with the input items which are designated by any one among these three groups of input keys, their input amounts are either set or adjusted in accordance with the position of an operator's touch which takes place at an intended location along the length of this touch bar.

On the lower side of the touch bar 114, there are disposed, running along therewith, bar-shaped indicators 116, 118 and 120 each having a length equal to that of the touch bar 114. Also, on the upper side of the touch bar 114, there are provided, extending along therewith, bar-shaped indicators 122, 124 and 126 each having a length equal to that of the touch bar 114. The indicators 116 and 126 are each illuminable, and they are arranged to indicate the amount of setting or adjustment as the location of touch goes along the length of this bar 114.

The indicator 116 is illuminated when a desired note pitch is designated by the group 86 of input keys, and is arranged to indicate the amount of the pitch adjustment in different ranges, i.e. the range of ±60 percent and ±15 percent. In such a case, it should be noted that, at the touch bar 114, it is possible to effect a pitch adjustment for a designated note pitch within the range of ±60 percent provided the pitch expand key 46 is turned on. When, however, the input key 46 is turned on, it is not possible to effect a higher resolution of pitch adjustment for the designated note within the range of ±15 percent.

The indicator 118 is illuminated when the tempo key 36 is turned on. This indicator is arranged to indicate an amount of tempo-setting within the range of number from 20 to 220 per minute in terms of the number of quarter notes. In this case, it is possible to set any arbitrary tempo on the touch bar 114 within the scope of 20 to 220 in number per minute.

The indicator 120 is illuminated when the input key 28, 38, 40, 42 or 44 is turned on and it is assigned to indicate a numerical figure "1" to "8". When the input key 28 is turned on, it is possible to select on the touch bar 114 and arbitrary one of the eight subtimbres corresponding to the numerals "1" to "8" mentioned above. Also, when the input key 38, 40, 42 or 44 is turned on, it is possible to select on the touch bar 114 any arbitrary one among the eight-step effect degrees (or effect patterns) corresponding to the numerals "1" to "8".

The indicator 122 is illuminated when a desired note duration is designated by the group 26 of input keys, and it is adapted to indicate a time length of tone generation of a note within the range of 0 to 100% of the standard note duration designated above. In this case, it is possible to select on the touch bar 114 any time length of tone generation of the designated standard note duration within the range of 0 to 100% relative thereto.

The indicator 124 is illuminated when the input key 32 or 34 is turned on, and it will indicate eight-steps of loudness from pianississimo (ppp) through to fortississimo (fff). In this state, it is possible to set on the touch bar 114 an arbitrary loudness within the range of ppp to fff.

The indicator 126 is illuminated when the input key 30 or 35 is turned on. It is assigned to indicate the amount of degree of either mellow or bright tone quality. In such case, it is possible to set on the touch bar 114 an arbitrary tone quality in the range from the mellowest tone quality available if touched at a location near the extreme left end of the bar up to the brightest tone quality which is available likewise near the extreme right end of the bar.

Arrangement of Apparatus

Figure 2:
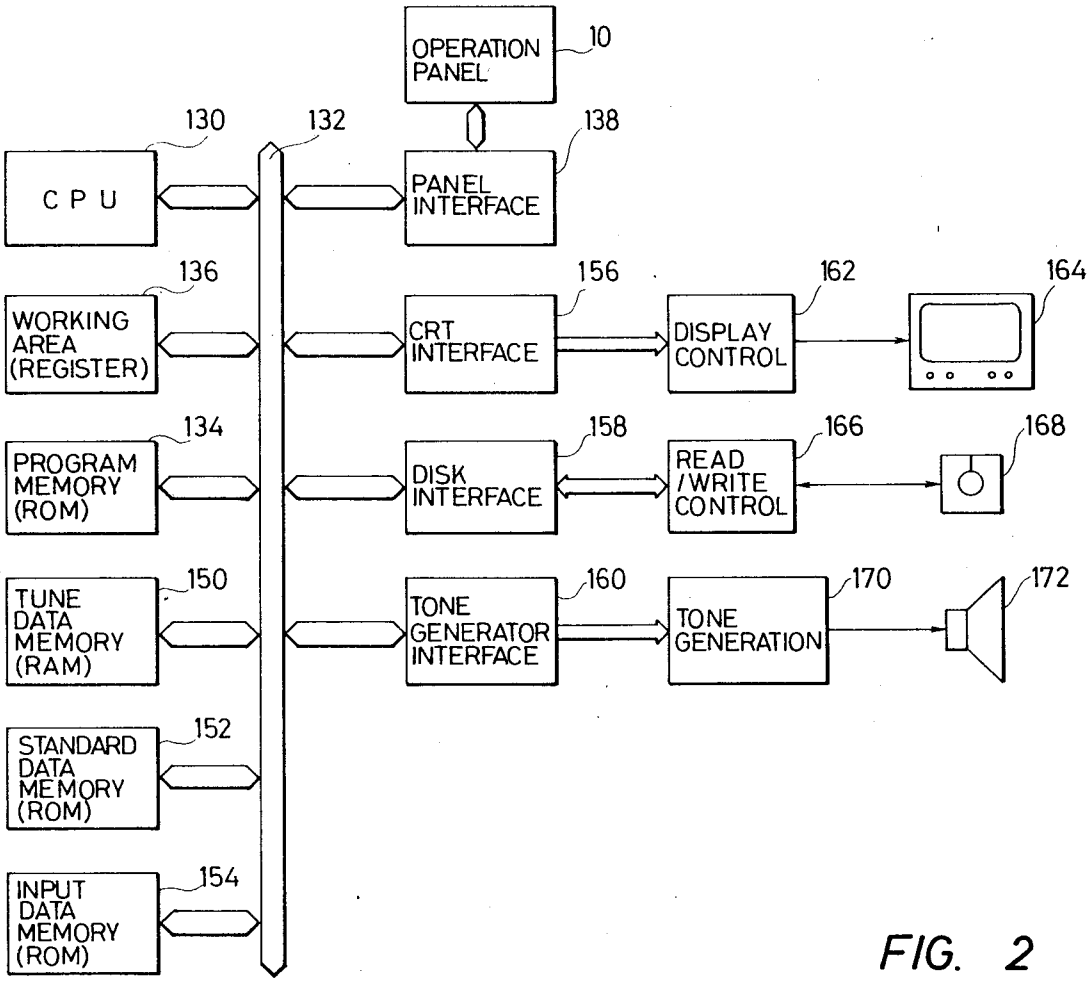
FIG. 2 is a block diagram showing an example of arrangement of automatic performing machine equipped with the data input apparatus of FIG. 1.

FIG. 2 shows the arrangement of an automatic music performing machine equipped with the above-described musical data input apparatus. This automatic performing machine is so arranged that such operations as inputting of data from the operation panel, data input/output from and to the floppy disk, display on the CRT and generation of musical tones are all controlled by the aid of a microcomputer.

A central processing unit (CPU) 130 is operatively coupled, via a bus line 132, to a program memory 134 consisting of a ROM (Read Only Memory) and also to a working area 136 containing various registers. This CPU 130 is operative so that it carries out data processing and data controlling for the above-mentioned various operations in accordance with the program stored in the program memory 134.

Figure 3:
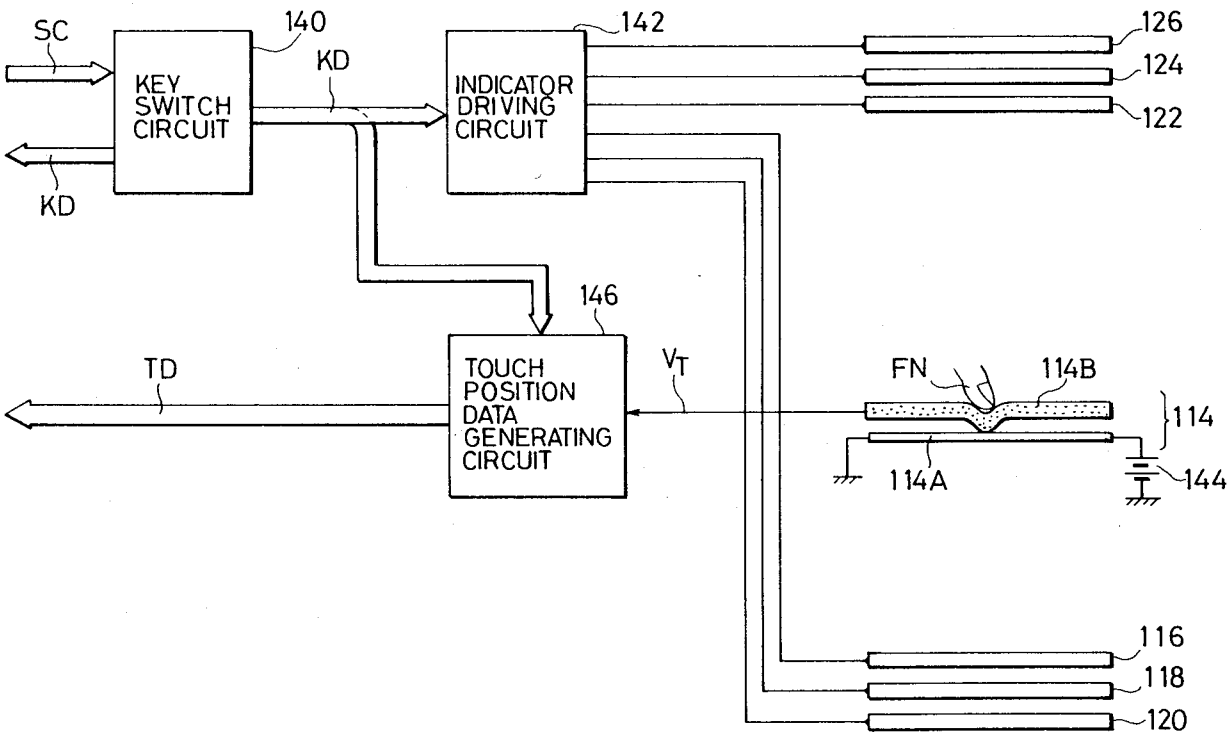
FIG. 3 is a block diagram showing the circuit arrangement of the operation panel of FIG. 1.

The circuit section of the operation panel 10 is coupled, via a panel interface 138, to the bus 132, and it has such a circuit arrangement as shown in FIG. 3 as an example. In FIG. 3, a key switch circuit 140 contains a number of key switches corresponding respectively to the numerous keys described above. This key switch circuit 140 is arranged to be operative that, by scanning these key switches in accordance with a scan signal SC delivered from the panel interface 138, the key which is being operated is detected to generate a key operation data KD. This key operation data KD is supplied to the panel interface 138 and also to an indicator driving circuit 142.

The indicator driving circuit 142 effects selective illumination of the aforesaid six indicators 116 to 126 in accordance with the key operation data KD. One of the indicators will be illuminated according to which one of the keys was just depressed as stated above.

The touch bar 114 comprises, for example, an elongated resistance member 114A and an elastic conductor 114B held above said resistance member 114A via a very small clearance and provided, at its upper surface, with an insulating film. This elongated resistance member 114A is supplied with a predetermined voltage across the opposing ends thereof from a power supply 144. When the tip of the operator's finger FN touches an arbitrary position of the upper surface of the elastic conductor 114B, there is derived from this elastic conductor 114B a voltage signal $V_T$ corresponding to the touch position on the conductor, and this voltage signal $V_T$ is supplied to a touch position data generating circuit 146. It should be noted here that arrangement may be made so that the detection of the touch position on the touch bar 114 is effected by such other means as a plurality of sensitive switches or touch switches which are disposed in a row.

The touch position data generating circuit 146 converts the voltage signal $V_T$ to a digital signal, and based on this digital signal and a key operation data KD, generates a touch position data TD conforming to the operated key. The reason why a touch position data TD is formed by taking the key operation data KD into consideration as stated above is because, even when a same position in the length of the touch bar 114 is touched repeatedly for different input items, there could be such instances that these touches have to be treated as indicating different touch positions relative to each other for the different input items. The touch position data TD is supplied to the panel interface 138.

To the bus 132 are coupled a tune data memory 150 which is comprised of a RAM (Random Access Memory), a standard data memory 152 which is comprised of a ROM (Read Only Memory) and an input data memory 154 which is comprised of a ROM.

The tune data memory 150 is capable of storing a performance data up to sixteen parts with respect to a desired tune. Its storage data format is as exemplified in FIG. 4. More particularly, the performance data of respective parts such as the performance data of the first part, the performance data of the second part, and so on are disposed in successive fashion. The performance data of each part is comprised, as shown typically with respect to the second part, of part-relating data P wherein part number data, tonality data, meter data, timbre data (which includes the timbre data peculiar to the musical instruments involved, sub-timbre data, and mellow/bright tone quality data), and tempo data are arranged successively. These serial data are followed by successively disposed tone-relating data Q for each note. Each data which constitutes the groups P and Q is comprised, as shown typically with respect to part number data, of a portion indicative of an identification code and a portion indicative of data contents.

Here, as the tone-relating data Q of the first note, such data as note pitch/note duration data (of which the note duration data includes notational length data and sounding length data), loudness data, portamento effect data, attack pitch effect data, delay vibrato effect data and random effect data are disposed in successive fashion. Also, the tone-relating data of the second note and the notes thereafter each invariably contains note pitch/note duration data for each note. With respect to tonality, meter, timbre, loudness, portamento effect, attack pitch effect, delay vibrato effect, random effect and like items, however, it should be understood that, only when there is introduced a variation in the set amounts of these items, a data corresponding to such amount of variation is included. It should be noted here also that, with respect to "rest", the whole bits of the note pitch data among the note pitch/note duration data are rendered to "0", so that the "rest" length will be indicated by note duration data.

Figure 4:
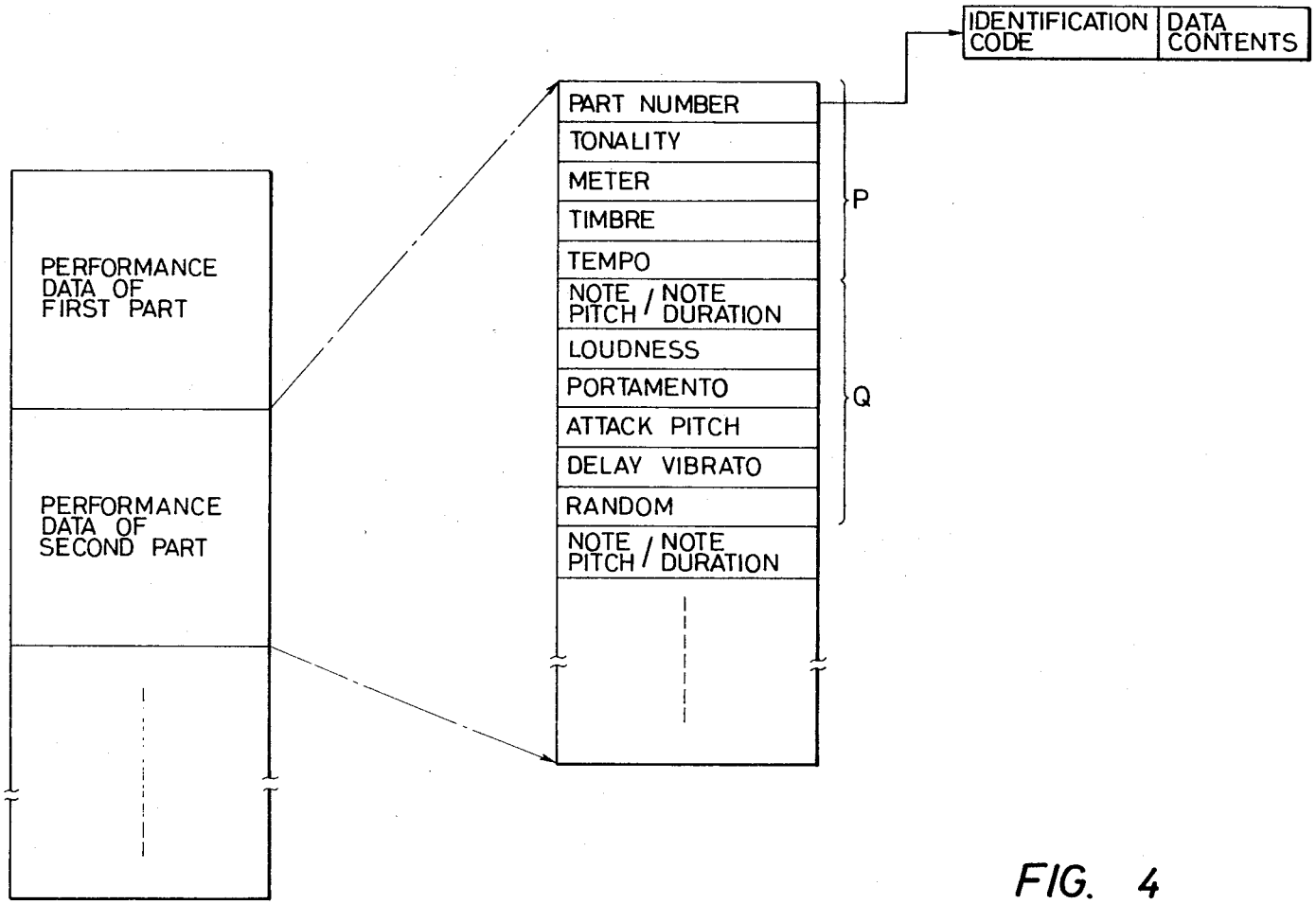
FIG. 4 is an illustration showing a stored data format of a tune.

The standard data memory 152 stores for each part, in the form of a format similar to that described in connection with FIG. 4, a performance data which will serve as the standard when the operator makes a performance data input operation. Such a performance data which will become the standard is written, prior to the commencement of the input operation, into the tune data memory 150 from the standard data memory 152, and the input operation is carried out in the form of adjusting the standard performance data. In other words, unless there is effected any specific setting operation or adjusting operation on the operation panel 10 with respect to such input items as note pitch, note duration and tone character control, the standard performance data will be used as the input performance data.

The input data memory 154 stores a larger number of concrete input data for each input item such as part number, tonality, meter, musical instrument timbre, sub-timbre, mellow/bright tone quality, tempo, note pitch, notational length, sounding length, time length of rest, loudness and abovesaid various effects. The stored data of this memory 154 are adapted to be read out selectively is accordance with key operation data KD, touch position data TD and like data. The data thus read out in supplied to the tune data memory 150 to be used for the purpose of the abovesaid adjustment of the standard performance data. More particularly, the standard performance data stored in the tune data memory 150 is either locally or entirely adjusted by the input data read out from the memory 154 in accordance with the panel operation. Therefore, the contents of the performance data stored in the tune data memory 150 will become those which reflect the intention of the operator.

To the bus 132 are coupled a CRT interface 156, a disk interface 158 and a tone generator interface 160. A display control circuit 162 is arranged so as to receive display data from the CRT interface 156 and to cause a CRT display unit 164 to display the data. A read/write control circuit 166 is arranged to receive performance data for writing purpose from the disk interface 158 and to cause a floppy unit disk 168 to write this data on its disk, and on the other hand to read out performance data for one piece of tune from the floppy disk unit 168 and to supply this data to the disk interface 158. A tone generating circuit 170 is assigned to receive note pitch data and note character control data from the tone generator interface 160 to generate a tone signal. The tone signal thus generated is converted to a sound by a loudspeaker 172. From this loudspeaker 172 is produced a sound at the time of voice check and also at the time of automatic performance.

Main Routine

Figure 5:
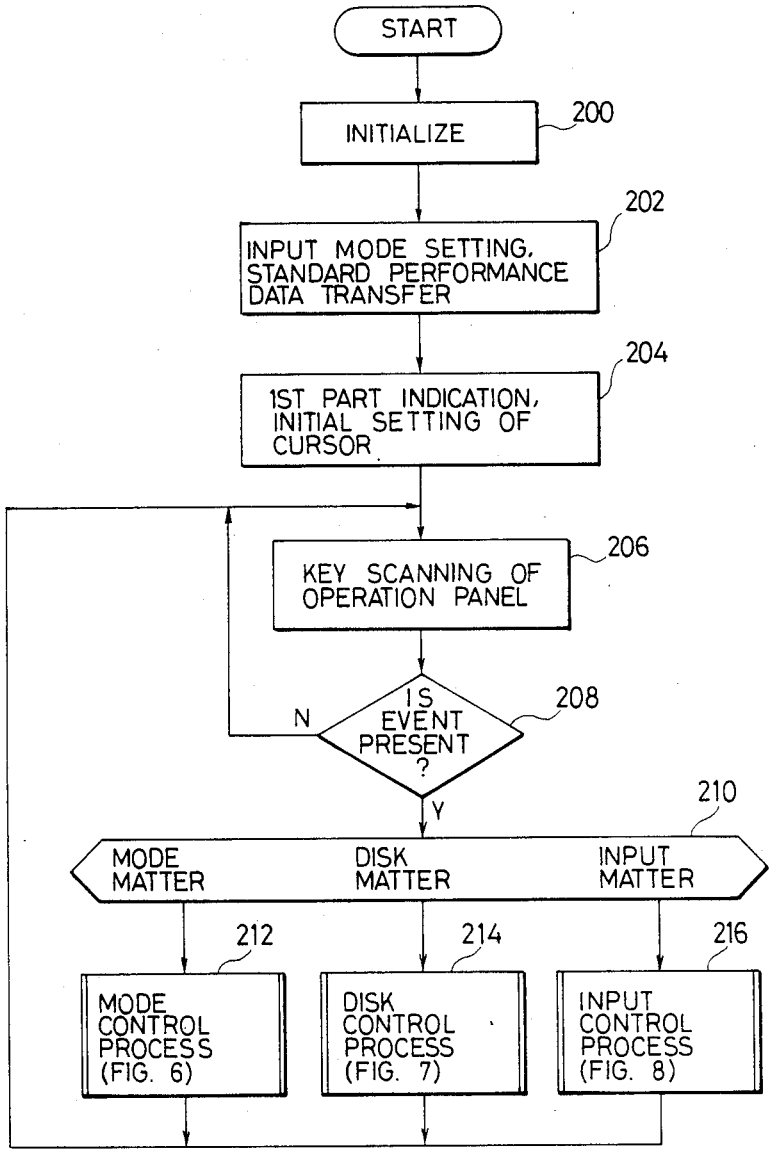
FIG. 5 is a flow chart showing the process of main routine.

FIG. 5 shows the process of the main routine.

When the power supply switch (not shown) is turned on, the main routine is started. More specifically, first of all, in Step 200, an initializing process is carried out to clear the registers, etc. of the working area 136.

Next, process is shifted to Step 202, wherein an input mode as the initial mode. As a result, on the operation panel 10, the light-emitting device 16 is lit. Also, standard performance data stored in the standard data memory 152 is transferred to the tune data memory 150. Here, as the standard performance data, there is employed a simple data such that quarter notes of a certain fixed note pitch are played successively.

Next, in Step 204, from among the standard performance data stored in the tune data memory 150 the performance data of the first part is read out and it is supplied, via the CRT interface 156, to a display control circuit 162. This display control circuit 162, based on the data then supplied, displays on the display face of the CRT 164 the performance data of the first part in the form of a staff, and concurrently therewith it positions the cursor at the initial location.

Thereafter, in Step 206, by scanning the numerous key switches provided on the operation panel 10, it is determined whether or not there is an event (meaning "on" or "off" status of keys) in Step 208. And, if there is no event (N), the scanning is repeated, and if there is an event (Y), the process of Step 210 is carried out.

In Step 210, judgement is made whether the detected event is related to the setting of either the input mode or the performance mode (i.e. mode matter), or it is related to the read/write to and from the floppy disk (disk matter), or it is related to the input of performamce data (input matter). As a result, in case the event is a mode matter, the main routine process will shift to the mode control process sub-routine shown in FIG. 6; and if it is a disk matter, the main routine process will shift to the disk control process sub-routine of FIG. 7; and if it is an input matter, the process will be switched onto the input control process sub-routine of FIG. 8. And, upon completion of either one of these sub-routine processes, the main routine process is switched back to the key scanning of Step 206, and thereafter similar operations as described above are repeated.

Mode Control Process

Figure 6:
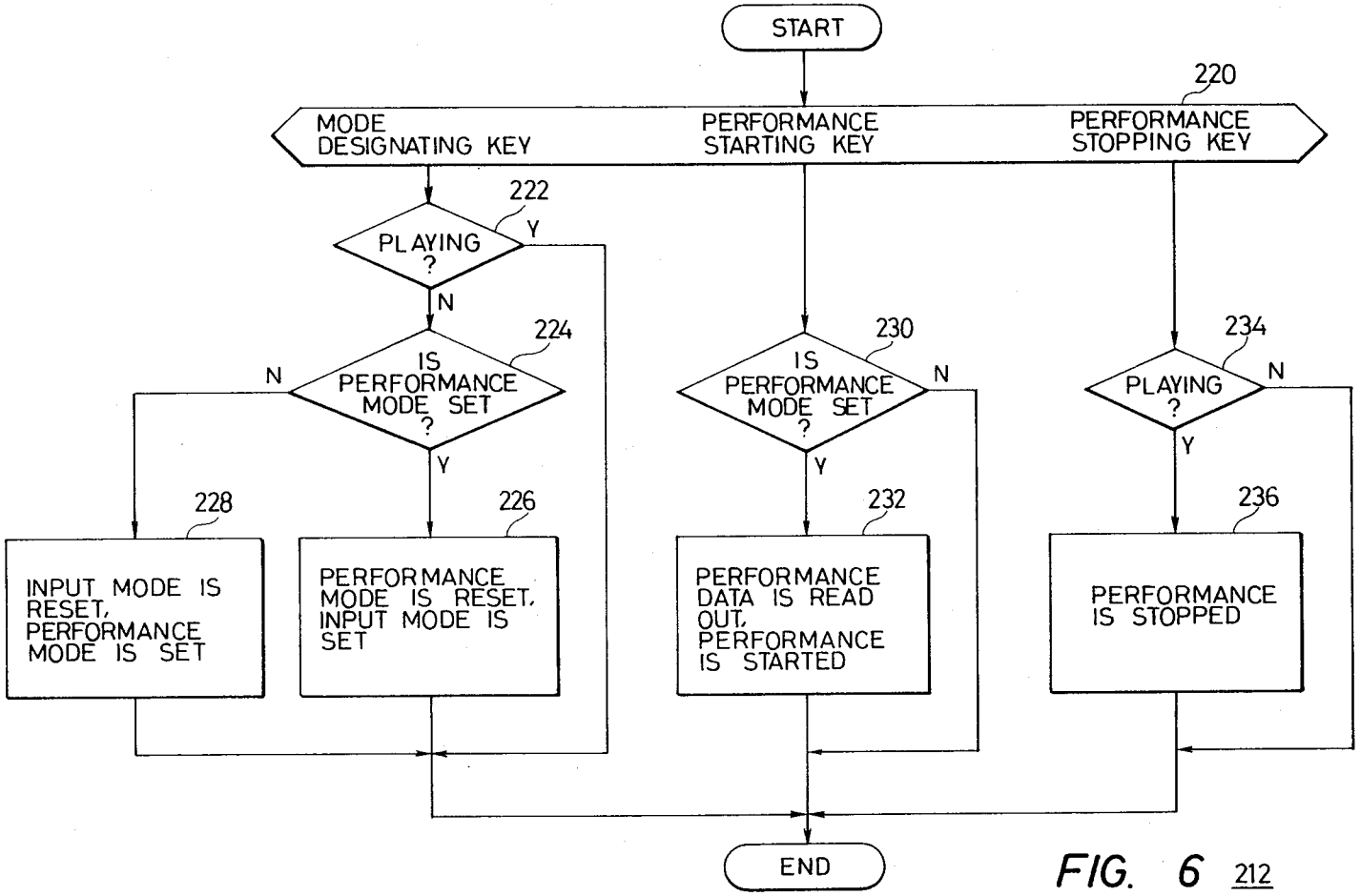
FIG. 6 is a flow chart showing a mode control process.

In the mode control process of FIG. 6, judgement is made in Step 220 whether the detected event is related to one of the operations of the mode designating key 12, the performance start key 18 or the performance stop key 20. As a result, if the event is found to be related to the operation of the mode designating key 12, process will shift to Step 222 wherein judgement is made whether the music is being played. If the judgement is yes (Y), the sub-routine is ended. However, if the judgement is no (N), judgement will be made next in Step 224 whether the performance mode is set.

Here, let us assume that the performance mode is set (Y). The process will shift to Step 226 wherein the performance mode is reset, while the input mode is set. Accordingly, on the operation panel 10, the light-emitting device 14 is extinguished while the light-emitting device 16 is illuminated. Also suppose the performance mode is not set (N), this will mean that the input mode is set. Therefore, process will shift to Step 228, wherein the input mode is reset and the performance mode is set. Accordingly, on the operation panel 10, the light-emitting device 16 goes out and the light-emitting device 14 is lighted up.

It should be noted here that, in Step 222, mode designating process during playing is inhibited, so that when it is intended to set the input mode during a play, it is only necessary to operate the play stop key 20 to stop the performance first and thereafter to operate the mode designating key 12.

On the other hand, in case the event is related to the operation of the play start key 18 or the play stop key 20, the below-mentioned process is carried out. To begin with, for the operation of the play start key 18, judgement is made in Step 230 as to either or not the performance mode is set. And if the performance mode is not set (N), process is ended. If, however, the performance mode is found to be set (Y), process will then shift to Step 232, and performance data is read out from the tune data memory 150 to the tone generator interface 160, and thus an automatic performance is started. Also, with respect to the play stop key 20, judgement is made in Step 234 whether the music is being played. And if the result is no (N), process is ended. If, however, the music is being played (Y). process will then shift to Step 236, wherein the read-out of the performance data from the tune data memory 150 is suspended, and thus the automatic performance is brought to a halt.

Disk Control Process

Figure 7:
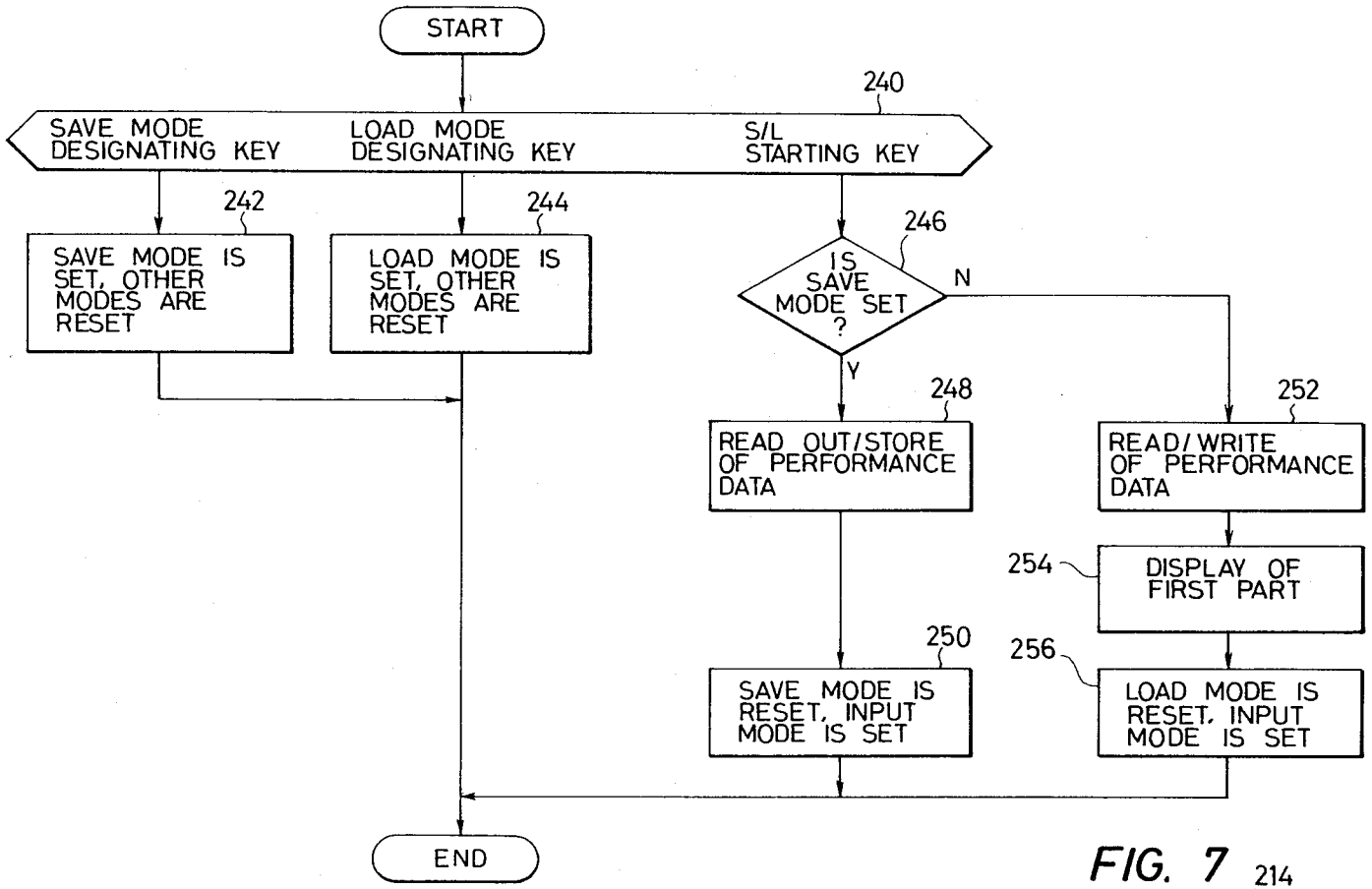
FIG. 7 is a flow chart showing a disk control process.

In the disk control process of FIG. 7, judgement is made in Step 240 as to whether the event is related to the operation of save mode designating key 72, or of load mode designating key 74 or of S/L start key 106. As a result, if the event is related to the operation of the save mode designating key 72, the save mode is set, while other modes (load mode, performance mode or input mode) are reset in Step 242. Also, if the event is related to the operation of the load mode designating key 74, load mode is set, and other modes (save mode, performance mode or input mode) are reset in Step 244.

On the other hand, if the event is related to the operation of the S/L start key 106, judgement is made in Step 246 whether save mode is set. As a result, if save mode is found to be set (Y), the process will shift to Step 248. In this Step 248, performance data is read out from the tune data memory 150 to the disk interface 158, and this data is written in the floppy disk 168 via the read/write control circuit 166. And, upon completion of such a writing operation, save mode is reset, and also input mode is set in Step 250, and with this the process is ended.

Also, if save mode is not set (N), this means that load mode is set, and accordingly process will shift to Step 252. In this Step 252, performance data is read out from the floppy disk 168 via the read/write control circuit 166, and this data is written in the tune data memory 150 via the disk interface 158. Upon completion of such a writing operation, the performance data for the first part is read out from the tune data memory 150, and it is supplied to the CRT interface 156, and thus the performance data for the first part is displayed, in the form of a staff, on the CRT display face. Thereafter, load mode is reset, while input mode is set in Step 256, and with this the process is ended.

Input Control Process

Figure 8:
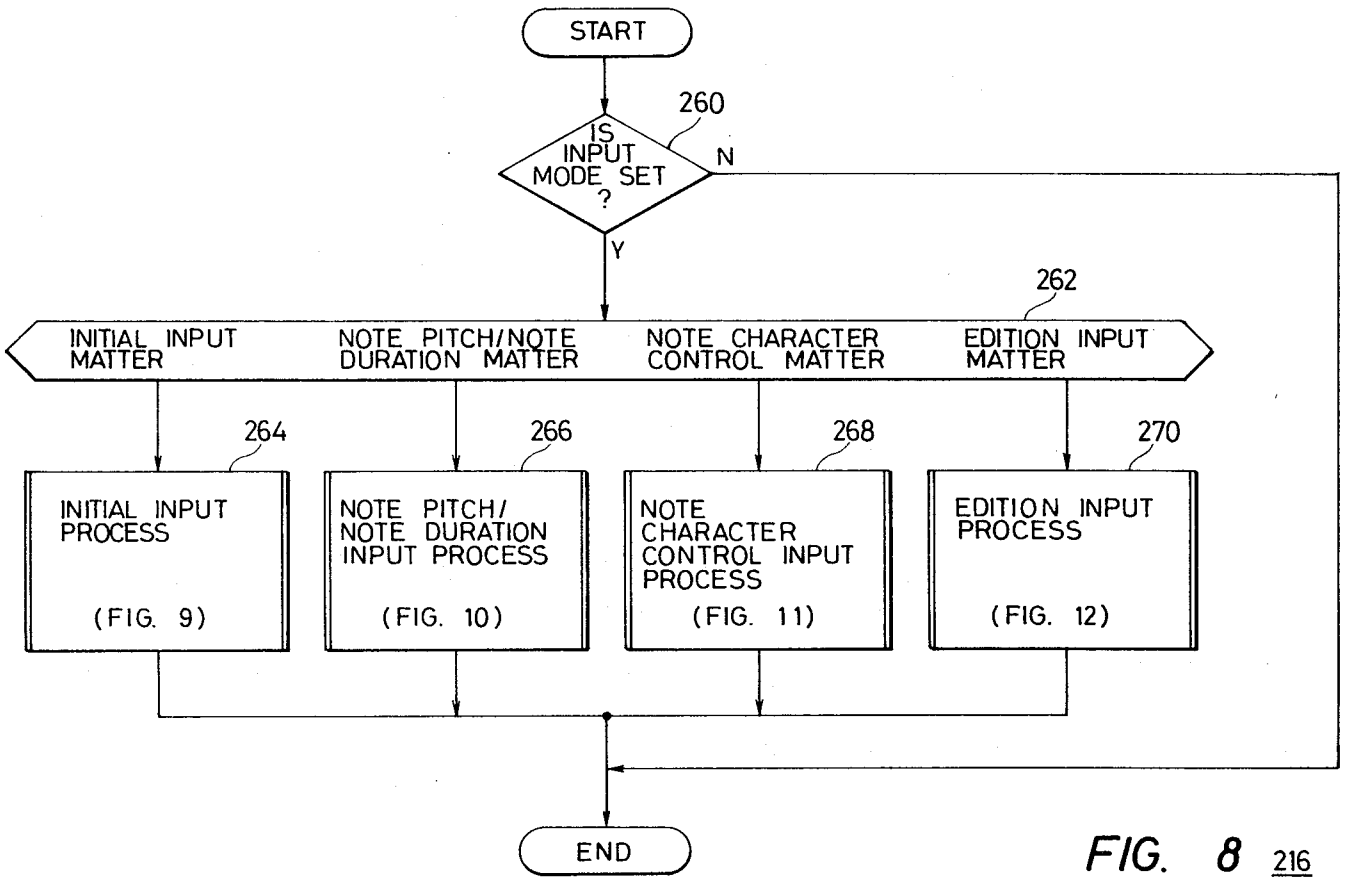
FIG. 8 is a flow chart showing an input control process.

In the input control process of FIG. 8, judgement is made in Step 260 whether input mode is set, and if it is not found to be set (N), process is ended.

Contrariwise, if input mode is found to be set (Y), process will shift to Step 262. In this Step 262, judgement is made whether the event is related to the operation of either the part number designating key 78, or of the meter designating key 80, or of the tonality designating key 82 or of the musical instrument timbre designating key 84 (these are initial input matters); or related to the operation of the flat designating key 80, or of the natural designating key 82, or of the sharp designating key 84, or of either one of the group 86 of note pitch designating input keys or of either one of the group 26 of note duration designating input keys (these are note pitch/note duration matters); or related to the operation of either one of the group 24 of note character control item designating input keys (note character control matter); or related to the operation of the setting key 110 or 112, or of the cursor shifting key 72 or 74, or of the delete key 108 or of the insert mode designating key 94 (edition input matter).

Figure 9:
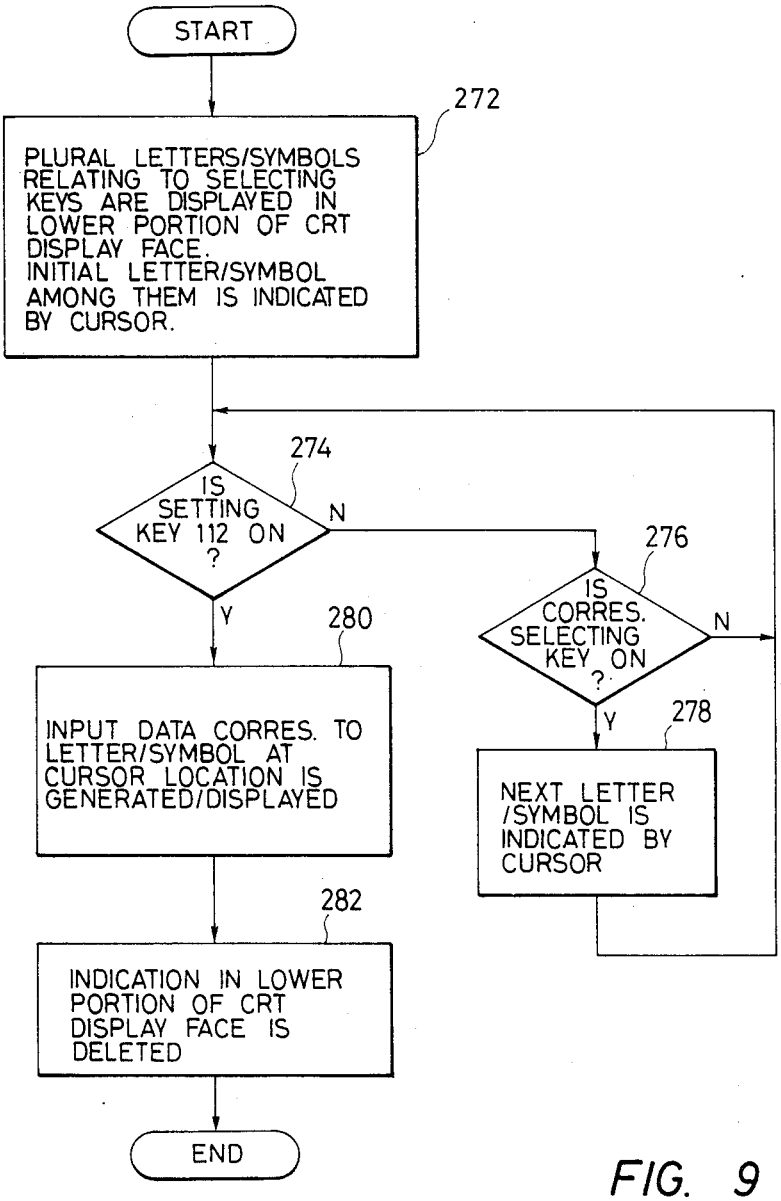
FIG. 9 is a flow chart showing an initial input process.

If the result of such a judgement finds that this process is an initial input matter, process will advance to the initial input process sub-routine 264 of FIG. 9. And, if the process is found to be the note pitch/note duration matter, process will shift to the note pitch/note duration input process sub-routine of FIG. 10. Also, if the process is the note character control matter, process will shift to the note character control input process sub-routine 168 of FIG. 11. And, if the process is noted to be the edition input matter, process will shift to the edition input process sub-routine of FIG. 12.

Initial Input Process

FIG. 9 shows the initial input process with respect to one key (hereinafter referred to as a selecting key) among the abovesaid initial input matter keys 78, 80, 82 and 84. Process is carried out in a similar way also for the rest of the keys.

To begin with, in Step 272, a plurality of letters or symbols relating to selecting key are displayed in the lower portion of CRT display face, and either the first letter or symbol among them is indicated by cursor. Such a display on the CRT display face is intended to make possible the selection of input data so as to be made by the selecting key. If the selecting key is the part number designating key 78, the display will indicate a part number of (1) to (16); if it is the meter designating key 80, the indication will be a time signature of 16 kinds such as 2/2, 3/4, 4/4 and so on; if it is the tonality designating key 82, the indication will be a key signature of 14 kinds such as "F", "G", "A" and so on; and if it is the musical instrument timbre designating key 84, the indication will be the musical instrument timbre name of 16 kinds such as flute, oboe, piano, organ, guitar and so on.

Next, in Step 274, judgement is made whether the second setting key 112 is turned on. If it is not turned on (N), judgement will be made in Step 276 whether the said selecting key is turned on. As a result of this judgement, if said selecting key is turned on (Y), process will shift to Step 278, wherein the second letter or symbol displayed in the lower portion of the CRT face is pointed by cursor, and the process will be brought back to Step 274. When the turning-on operation of the selecting key is repeated in the abovesaid manner without turning the setting key 112 on, the cursor will indicate the displayed letters or the symbols one after another in the lower portion of the CRT display face. Therefore, it will be only necessary for the operator to turn-on the setting key 112 at a location which the cursor indicates.

By turning the setting key 112, on, the result of judgement in Step 274 becomes affirmative (Y), and process will shift to Step 280. In Step 280, an input data corresponding to the letter or the symbol located at the position of cursor is read out from the input data memory 154 and it is written in the tune data memory 150, and concurrently therewith, a letter or a symbol corresponding to the then read-out data is displayed in connection with a staff on the CRT display face.

It should be understood here that, in this case, in the tune data memory 150 and on the display face of CRT, there is stored and displayed, respectively, the first part of the standard performance data as has been described in connection with FIG. 5, and that, however, these stored contents and the contents of display will be altered in accordance with the input data generated in the process carried out in Step 280.

Thereafter, the display for selection of input data at the lower portion of CRT display face is deleted in Step 282, and will this the process is ended.

Note Pitch/Note Duration Input Process

Figure 10:
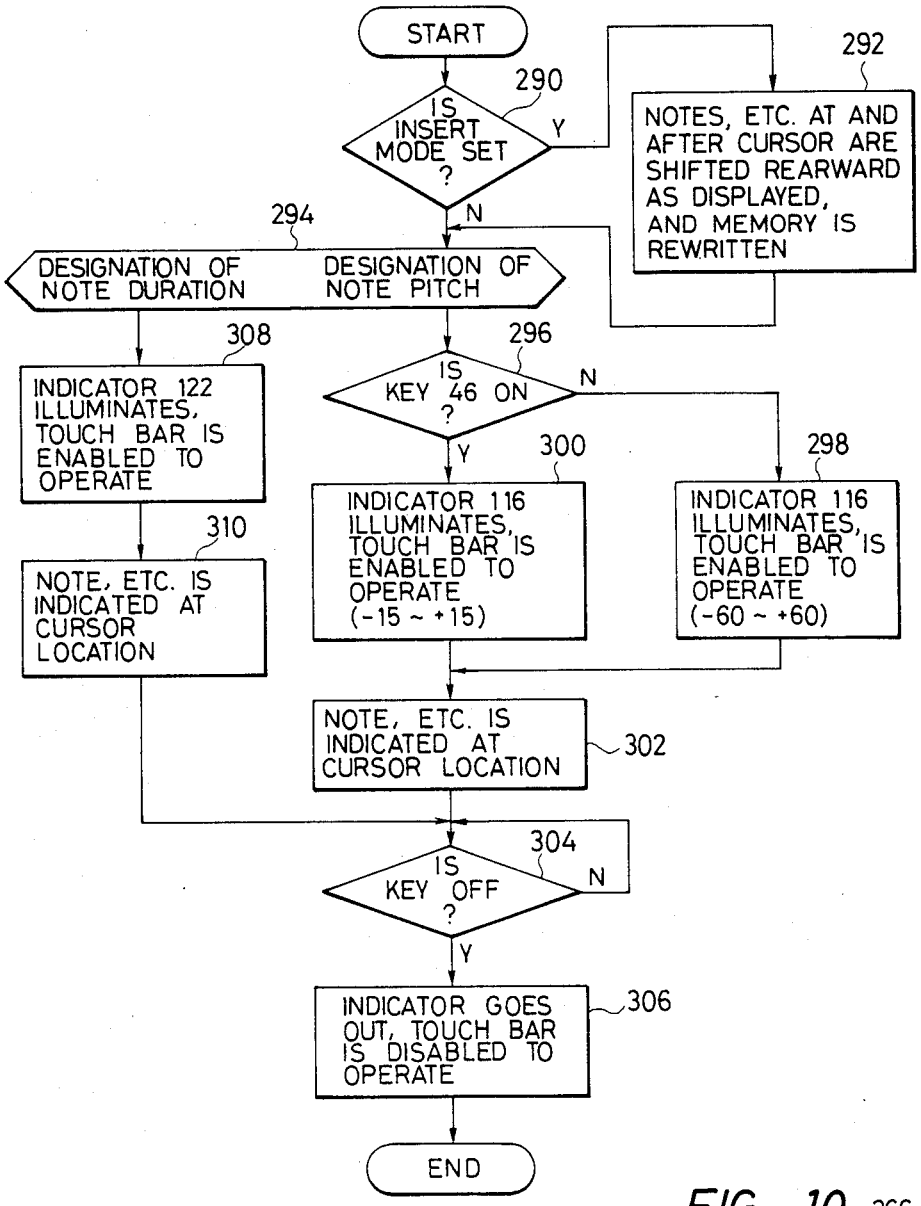
FIG. 10 is a flow chart showing an input process of note pitch/note duration.

In the note pitch/note duration input process of FIG. 10 judgement is made in Step 290 whether the insert mode is set. According to the judgement, process will be shifted to Step 294 in two different ways, i.e. via Step 292 if the insert mode has been set (Y), and directly to Step 294 if the insert mode is not set (N).

In Step 292, in order to enable an insertion display, the note, etc. located at and subsequent to the position of cursor are shifted rearward by one position at a time, and also the contents of the tune data memory 150 are rewritten correspondingly to the alteration of the contents of display.

In Step 294, judgement is made whether the input operation is related to note pitch designation or to note duration designation. If the input operation is related to note pitch designation, process will shift to Step 296.

In Step 296, judgement is made whether the input key 46 is turned on. If it is not turned on (N), the indicator 116 is illuminated in Step 298, and also a pitch adjustment by the touch bar 114 is enabled within the limits of ±60 cent. If the input key 46 is noted to be turned on (Y), the indicator 116 is lighted up in Step 300 and concurrently therewith a pitch adjustment in the range of ±15 cent by the touch bar 114 is enabled. Accordingly, on the touch bar 114, the note pitch which has been designated by the group 86 of input keys can be adjusted appropriately within the range of either ±60 cent or ±15 cent, as the case may be.

Upon completion of Step 298 or 300, process will be shifted onto Step 302. In this Step 302, a note is displayed on the CRT display face at the location of cursor and also at the location of the designated note pitch in connection with the staff. In such a case, an accidental such as sharp, if designated already, will be displayed also. The note which is displayed in such a case is, for example, a quarter note based on the standard performance data unless note duration has been designated priorly.

Thereafter, judgement is made in Step 304 for "key off", and if there is a key-off (Y), process will shift to Step 306, whereas if there is no key-off (N), process will wait for a key-off.

In Step 306, the priorly illuminated indicator 116 extinguishes, and concurrently therewith the pitch adjustment by the touch bar 114 is disabled, and then the process is ended.

Now, in Step 294, when the input operation is judged to be related to note duration designation, process will shift to Step 308. In Step 308, the indicator 122 is lighted up and concurrently therewith a sounding length designation by the touch bar 114 is enabled. Accordingly, on the touch bar 114, an arbitrary sounding length can be set within the range of 0 to 100% for the note, for example an eighth note, which has been designated by the group 26 of input keys. In case, however, such a specific sounding length designation as mentioned above is not effected, a sounding length which may be 80% for example is set based on the standard performance data.

Next, in Step 310, a designated note (which, in the abovesaid example, is an eighth note) is displayed on the CRT display face at the location of cursor in connection with the staff. In this case, if a note duration designation has been effected following the abovesaid note pitch designation, the abovesaid display of the quarter note based on the standard performance data is altered to the display of a designated note (which, in the abovesaid example, is an eighth note). As a result, at the location of cursor on the staff a designated note will be displayed at the position of the designated note pitch.

Thereafter, similar to the abovesaid case of note pitch designation, key-off or not is judged in Step 304, and if key-off, the indicator 122, goes out and also sounding length designation by the touch bar 114 is disabled.

It should be understood here that, with respect to the note which is displayed, its note pitch data and note time length (time length of notation and time length of generated tone) data are read out from the input data memory 154 in accordance with key operation and touch bar operation, and they are temporarily stored in the working area 136 so as to be written in the tune data memory 150 based on the operation of the setting key 110 or 112 at the time of edition input which will be described later.

Note Character Control Input Process

Figure 11:
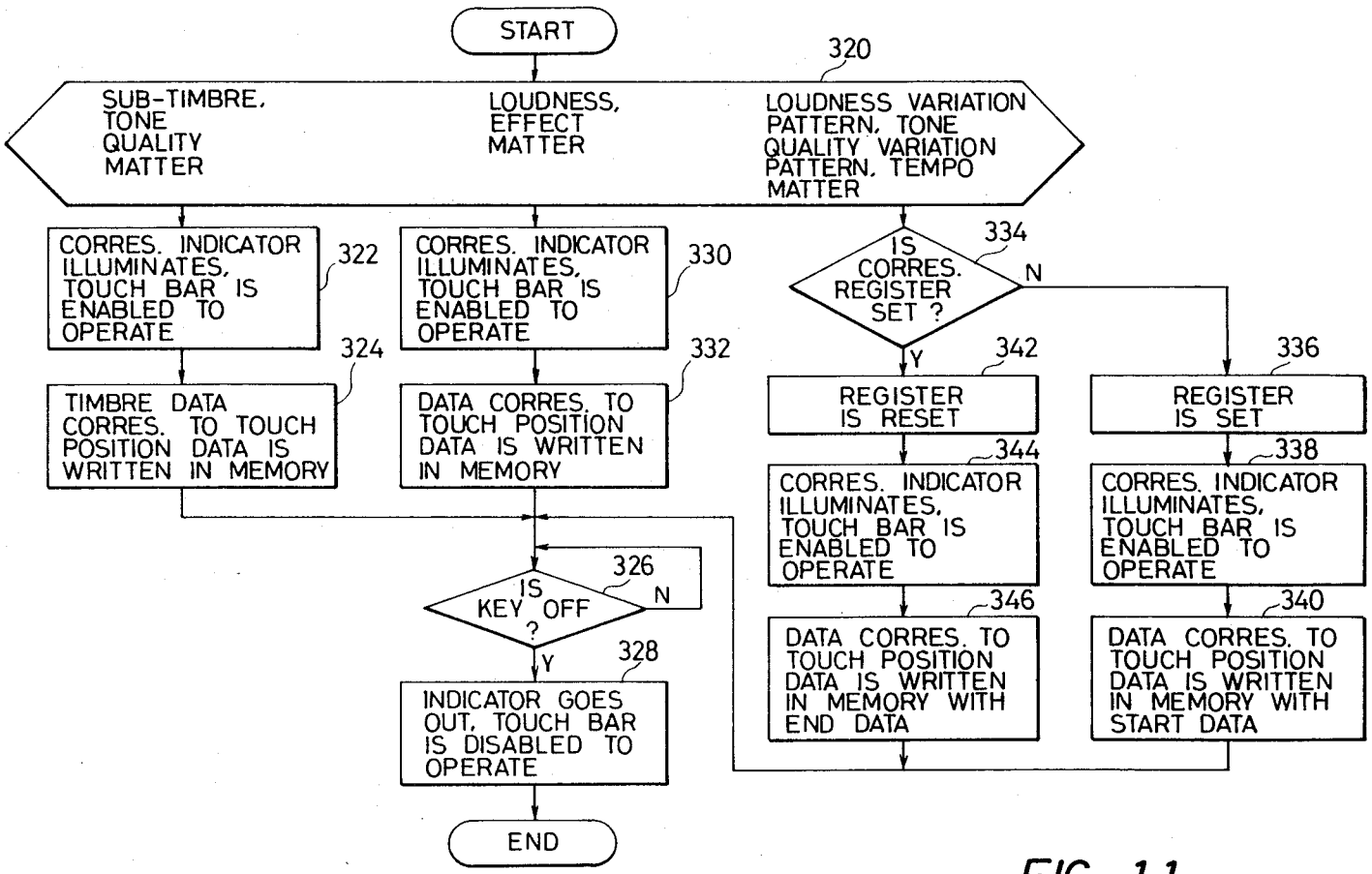
FIG. 11 is a flow chart showing an input process of note character control items.

In the note character control input process of FIG. 11, judgement is made in Step 320 whether the input operation is related to input key 28 or 30 (sub-timbre or tone quality matter), or it is related to input key 32, 38, 40, 42 or 44 (loudness or effect matter), or it is related to input key 34, 35, or 36 (loudness variation pattern, tone quality variation pattern or tempo matter).

As a result, if the input operation is a sub-timbre or tone quality matter, process will shift to Step 322, wherein corresponding indicator 120 or 126 is lighted up, and concurrently a setting by the touch bar 114 is enabled. Accordingly, on the touch bar 114, if the input key 28 is turned on, there can be set an arbitrary sub-timbre, using the indicator 120 as the measure; and if the input key 30 has been turned on, it is possible to set an arbitrary mellow/bright tone quality using the indicator 126 as the measure. The result of such a setting operation is displayed in the lower portion of the CRT display face in connection with the diagram of the touch bar. It is added here that, in order to facilitate the selection of sub-timbre at the time of illumination of the indicator 120, a plurality of sub-timbres are displayed by letters, diagrams or the like in correspondence to (1) to (8), in the lower portion of the CRT display face.

Next, in Step 324, a timbre data complying with a touch position data TD is read out from the input data memory 154 and it is written in the tune data memory 150 as a data concerning the note at the location of cursor. It should be noted here that, unless a setting is effected by the touch bar with respect to the sub-timbre and mellow/bright tone quality, the sub-timbre and the mellow/bright tone quality will be determined based on the standard performance data.

Thereafter, judgement is made in Step 326 whether there is a key-off, and if there is a key-off (Y), process will shift to Step 328, whereas if no key-off, process will await a key-off information.

In Step 328, the priorily illuminated indicator 120 or 126 goes out, and concurrently the setting by the touch bar 114 is disabled, and thereafter the process is ended.

In the judgement made in Step 320, if the judgement indicates a loudness or effect matter, process shifts to Step 330, and the corresponding indicator 120 or 124 is illuminated, and concurrently therewith the setting by the touch bar 114 is enabled. Accordingly, on the touch bar 114, an arbitrary loudness can be set using the indicator 124 as the measure if the input key 32 has been turned on. Likewise, if either the input key 38, 40, 42 or 44 has been acutated, there can be appropriately set a degree of effect corresponding to the key which has been turned on using the indicator 120 as the measure therefor. And the result of such a setting operation is displayed in connection with the diagram of the touch bar in the lower portion of the CRT display face. It should be noted here that, in order to facilitate the selection of degree of effect at the time of illumination of the indicator 120, it is preferable that a plurality of effect degrees be indicated in the lower portion of the CRT display face either by letters, diagrams or the like in correspondence to (1) to (8).

Next, in Step 332, either a loudness data or an effect data corresponding to the touch position data TD is read out from the input data memory 154, and it is written in the tune data memory 150 as the data concerning the note present at the location of cursor. Unless there is effected a setting by the touch bar with respect to loudness and various effects, the degree of loudness and that of various effects will be determined based on the standard performance data.

Thereafter, key-off is judged in Step 326 in a manner similar to the instance of the abovesaid sub-timbre or tone quality matter. If a key-off is present, either the indicator 120 or 124 goes out in Step 328, and concurrently therewith, the setting by the touch bar 114 is disabled.

In the judgement made in Step 320, if the input operation concerns a loudness variation pattern or tone quality variation pattern or tempo matter, process shifts to Step 334, wherein judgement is made whether the corresponding register in the working area 136 has been set.

As a result, if the corresponding register has not been set (N), this register is set in Step 336 and thereafter process will shift to Step 338.

In Step 338, either the corresponding indicator 118, 124 or 126 is illuminated, and concurrently therewith the setting by the touch bar 114 is enabled. Accordingly, on the touch bar 114, if the input key 34 is turned on, loudness can be set, and if the input key 35 is turned on, mellow/bright tone quality can be set, in a manner similar to that described above. If the input key 36 has been turned on, an arbitrary tempo can be set using the indicator 118 as the measure therefor. And, the result of such setting operation is displayed in connection with the touch bar diagram in the lower portion of the CRT display face.

Next, in Step 340, either a loudness data, mellow/bright tone quality data or tempo data in accordance with the touch position data TD is read out from the input data memory 154, and it is written in the tune data memory 150 as a data concerning the note present at the location of cursor. In this case, a start data indicative of the starting of temporary control is added to the write-in data. Thereafter, in a manner similar to that described above, process is ended via Steps 326 and 328.

As stated above, after the data relating to the commencement of temporary control has been inputted, it is the usual step to first input a performance data for an amount of a plurality of notes (for example 2 to 10 notes) and then to effect an input operation concerning the termination of temporary control. When this input operation is effected, the judgement in Step 334 indicates that the corresponding register is set (Y), and after this register is reset in Step 342, process shifts to Step 344.

In Step 344, in a manner similar to the above-described Step 338, a corresponding indicator is lighted up, and concurrently therewith, a setting by the touch bar 114 is enabled. For this reason, in a similar way as stated above, there can be effected a setting, by the touch bar 144, of loudness, mellow/bright tone quality or tempo.

Next, in Step 346, a loudness data, a mellow/bright tone quality data or a tempo data corresponding to the touch poisition data TD is read out from the input data memory 154, and it is written in the tune data memory 150 as a data concerning the note present at the location of cursor. In this case, the written-in data is added with end data indicative of the end of temporary control. Thereafter, in a manner similar to that described above, process is ended via Steps 326 and 328.

In case a data relating to temporary control is inputted in such a way as described above, it is only necessary for effecting an automatic performance to search and read out the input data added with the end data when the input data added with a start data is detected, and to determine either the direction of variation of loudness or the direction of variation of tone quality through comparison of the intensity of loudness or the intensity of the degree of mellow/bright tone quality with respect to the input data added with the start data and to the input data added with the end data. Such a comparison-based judgement process as described above can be eliminated if, on the operation panel 10 of FIG. 1, arrangement is provided so that a data concerning the direction of variation of loudness or the direction of variation of tone quality can also be inputted by using a shift key 348 provided at the left lower region of the panel. With respect to tempo data, there is no direction of variation. Therefore, such a comparson-based judgement process is not necessary.

Edition Input Process

Figure 12:
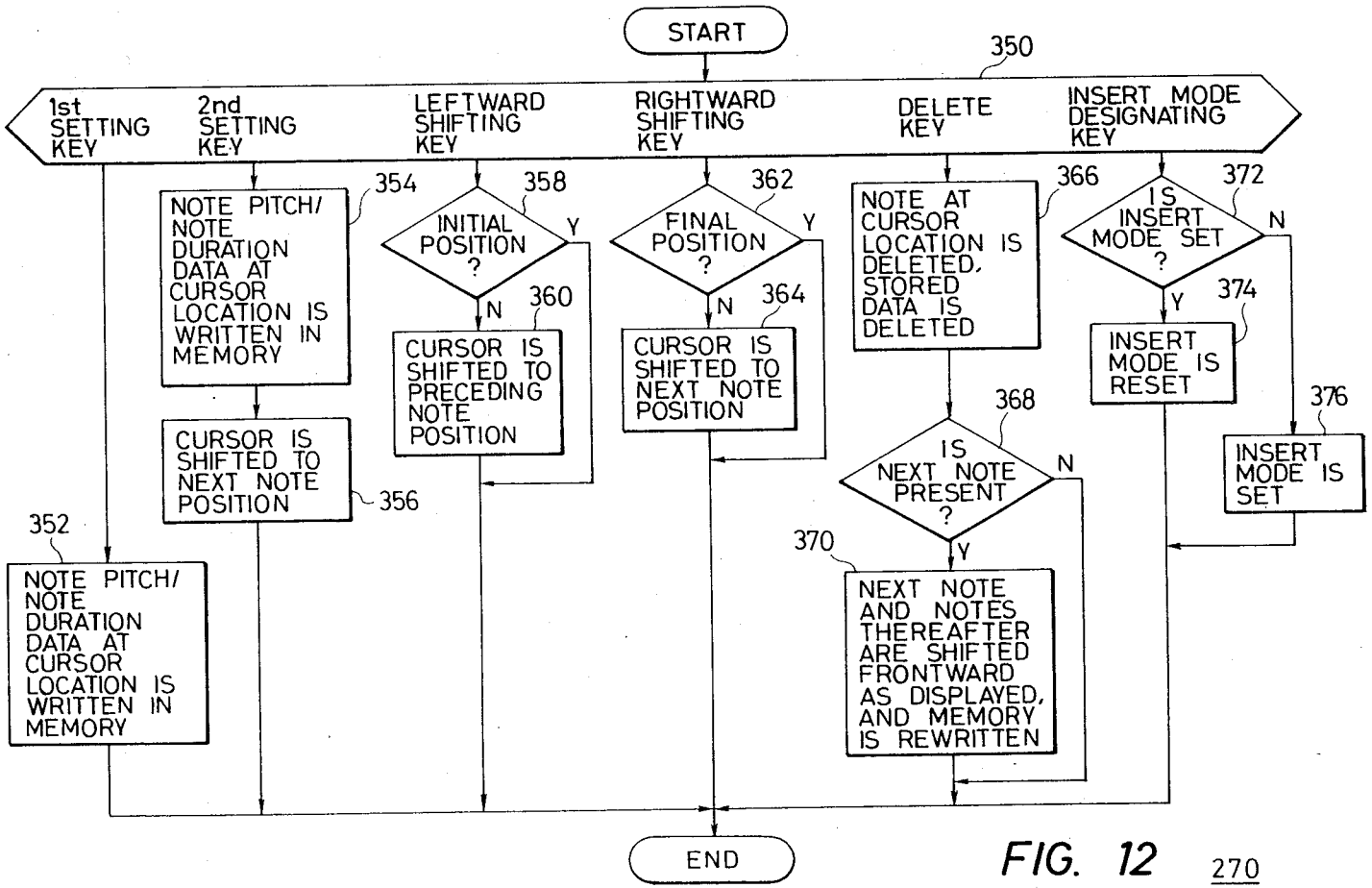
FIG. 12 is a flow chart showing an input process of editing.

On the edition input process of FIG. 12, judgement is made in Step 350 whether the input operation is related to either one of the first setting key 110, the second setting key 112, the cursor leftward shifting key 72, the cursor rightward shifting key 74, the delete key 108 or the insert mode designating key 94.

In case the input operation is found to be the operation of the first setting key 110, process will shift to Step 352. In this Step 352, the note pitch/note duration data present at the location of cursor is read out from the working area 136, and it is written in the tune data memory 150. In this case, the cursor will stay in its location on the CRT display face, and the note which is inputted next will enter in the same beat to constitute a chord.

In case the input operation is found to be the operation of the second setting key 112, process will shift to Step 354. In this Step 354, in a manner similar to that for Step 352, a note pitch/note duration data present at the location of cursor is written in the tune data memory 150. And, in Step 356, cursor is shifted to the location of the next note. For this reason, the note which is inputted next will be entered in the next beat.

In case the input operation is found to be the operation of cursor leftward shifting key 72, process will shift to Step 358. In this Step 358, judgement is made whether cursor is set at the initial location in connection with the staff. If it is found to be set at the initial location (Y), process is ended. Also, if it is not set at the initial location (N), process will shift to Step 360, and cursor will be shifted to the location of the preceding note.

In case the input operation is that of cursor rightward shifting key 74, process will shift to Step 362. In this Step 362, judgement is made whether cursor is set at the final location with respect to the staff. If it is set at the final location (Y), process is ended. Also, if it is not at the final location (N), process is shifted to step 364, and cursor is shifted to the location of the next note.

If the input operation is noted to be the operation of the delete key 108, process will shift to Step 366. In this Step 366, the note (or rest) present at the location of cursor is deleted, and concurrently therewith, and in correspondence to this deletion, the stored data in the tune data memory 150 is deleted. Next, judgement is made in Step 368 whether there is a next note (or rest) present. If no (N), process is ended. Also, if there is present a next note (Y), process will shift to Step 370, and the next note and notes thereafter are shifted stepwisely in forward direction as they are displayed. And, along therewith, in correspondence to this alteration of indication, the stored contents of the tune data memory 150 are rewritten.

In case the input operation is found to be the operation of the insert mode designating key 94, process will shift to Step 372. In this Step 372, judgement is made whether the insert mode is set. If it is noted to be set (Y), the insert mode is reset in Step 374, and if not set (N), the insert mode is set in Step 376. When the insert mode is set, in a manner as described above in connection with FIG. 10, those notes including the note present at the location of cursor and onward are shifted stepwise by one position at a time respectively as they are displayed, and then the contents of the tune data memory 150 are also rewritten. Thus, a desired note pitch/note duration data can be inserted at the location of cursor.

In the embodiment described above, arrangement is provided which makes it possible to input performance data for sixteen parts with respect to one tune. It should be understood, however, that arrangement may be made so that performance data of different tunes for respective parts can be inputted to realize successive or selective automatic performances of a plurality of tunes. Also, in the above-described embodiment, there has been shown an example of inputting melody performance data. It should be understood, however, that rhythm performance data may be inputted to realize an auto-rhythm performance.

Furthermore, as the fine setting means, there has been shown a rectangular oblong touch bar. It should be understood that this may be of a square shape for example, so that two dimensional designation may be made such that loudness is designated in direction X and timbre is designated the direction Y.

ANOTHER EMBODIMENT

Figure 13:
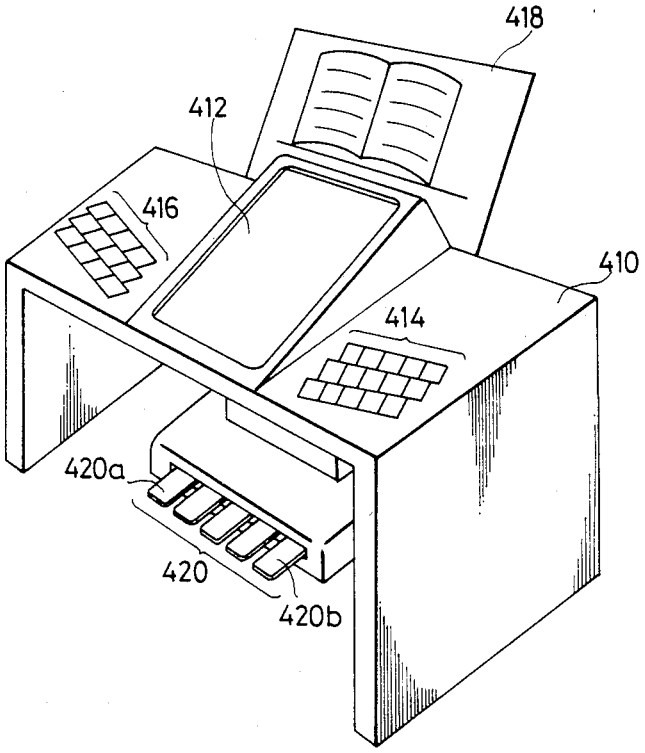
FIG. 13 is a diagrammatic perspective illustration showing a second embodiment of the data input apparatus according to the present invention.
Figure 14:
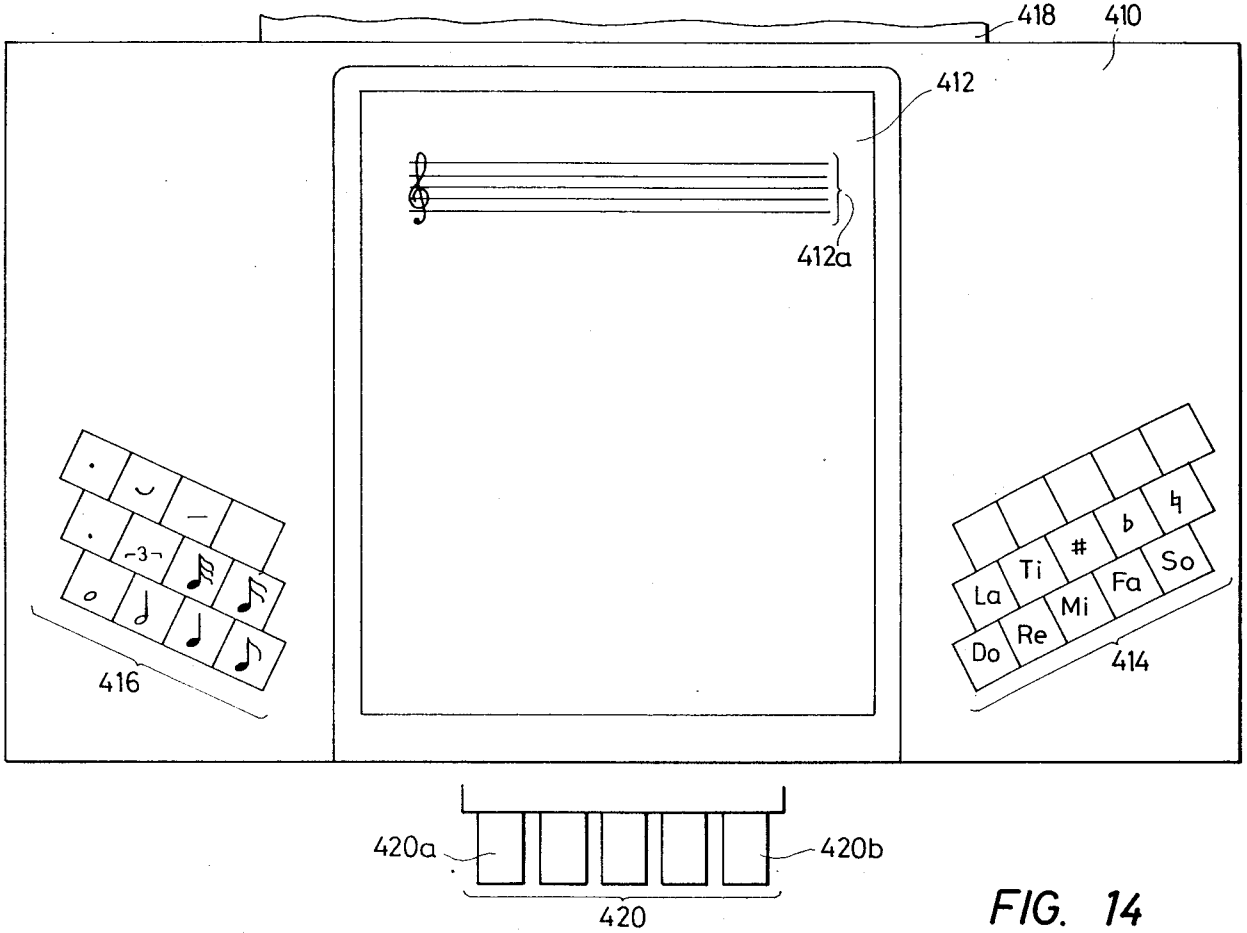
FIG. 14 is a diagrammatic plan view of the data input apparatus of FIG. 13.

FIGS. 13 and 14 show another embodiment of data input apparatus according to the present invention.

The body 410 of the apparatus is provided with a CRT display unit 412. On the right side and the left side of the CRT display unit 412 as viewed from the operator's side, there are provided a group 414 of note pitch designating keys and a group 416 of note duration designating keys, respectively. Also, in the back of the CRT display unit 412, there is provided a music rack 418, whereas below the CRT display unit 412, there is provided a group 420 of foot switches including note/rest designating switch 420*a* and input instructing switch 420*b*.

In the group 414 of note pitch designating keys, there are arranged keys bearing note names such as "Do", "Re", "Mi", and so on, in the order of a fingering allotment of the musical scale notes. Also, in the group 416 of note duration designating keys, there are arranged keys bearing the symbol marks of musical notations such as "whole note", "half note", "quarter note" and so on, in the order of the length of note durations.

Figure 15:
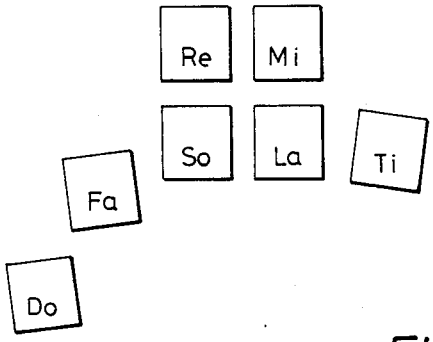
FIG. 15 is a diagrammatic illustration showing a modified example of arrangement pattern of note pitch designating keys shown in FIG. 14.

It should be understood here that the key arrangement in the group 414 of note pitch designating keys may be such that, as shown in FIG. 15, keys "Do", "Fa", "So", "La" and "Ti" are disposed in an arcuate row, and that, in the back of the keys "So" and "La", there are arranged keys "Re" and "Mi" in a side-by-side fashion. By this arrangement, the locations of keys are in agreement with the respective lengths of the operator's fingers, so that the operator will be able to depress the key "Do" with his thumb, while depressing other desired keys with his remaining four fingers, thus allowing a smoother fingering.

Figure 16:
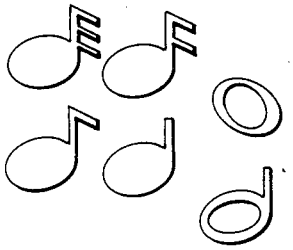
FIG. 16 is a diagrammatic illustration showing a modified example of formation of the note duration designating keys of the apparatus shown in FIG. 14.

The keys in the group 416 of note duration designating keys may have such shapes as corresponding to respective notations as shown in FIG. 16 Such an arrangement will give the operator an easiness in finding the keys which require to be depressed, thus further facilitating note duration designating operation.

Figure 17:
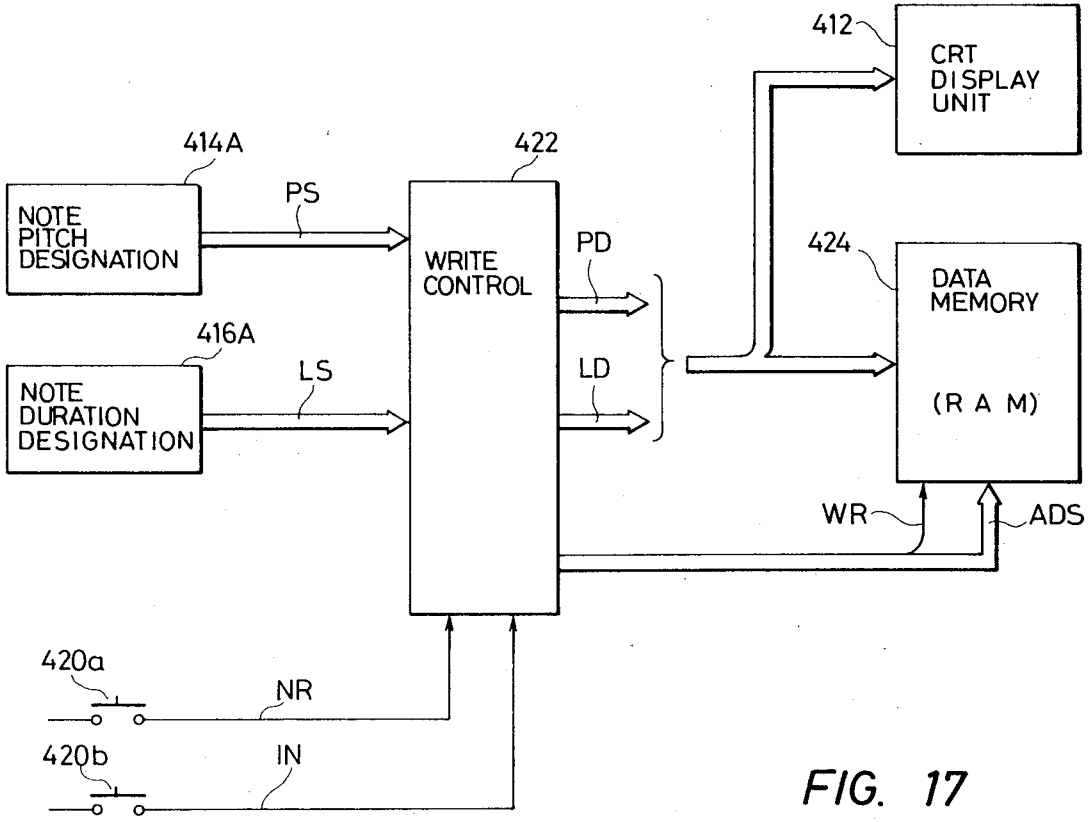
FIG. 17 is a block diagram showing the circuit arrangement of the data input apparatus of FIG. 13.

FIG. 17 shows the circuit arrangement of the above-mentioned musical note data input apparatus.

A note pitch designating circuit 414A is assigned to generate a note pitch designating signal PS based on a selective operation of those keys belonging to the said group 414 of note pitch designating keys. This note pitch designating signal PS is supplied to a write control circuit 422 to be converted to a note pitch code data PD corresponding to the disignated note pitch. Also, a note duration designating circuit 416A is assigned to generate a note duration designating signal LS based on a selective operation of those keys belonging to the group 416 of note duration designating keys. This note duration designating signal LS is delivered to the write control circuit 422 to be converted to a note duration code data LD corresponding to the designated note duration.

The write control circuit 422 is assigned to generate a write instruction signal WR and a write address signal ADS based on a note/rest designating signal NR delivered from the note/rest designating switch 420*a*and on an input instruction signal IN coming from an input instructing switch 420*b*. Arrangement is provided so that a note pitch code data PD and a note duration code data LD are written in a data memory 424 which is comprised of a RAM (Random Access Memory), in accordance with the write instruction signal WR and with the write address signal ADS. Also, the note/rest designating switch 420*a* is intended to designate a note in its "off" state, and to designate a rest in its "on" state.

When it is intended to input a note data, the operator is required to designate a note pitch by the group 414 of note pitch designating keys, while designating a note duration by the group 416 of note duration designating keys, and to cause the write control circuit 422 to generate a note pitch code data PD corresponding to the designated note pitch and also a note duration code data LD corresponding to the designated note duration. And, in this state, the operator turns on the input instructing switch 420*b*. Whereupon, the write control circuit 422 generates a write instruction signal WR and a write address signal ADS. In response thereto, a note pitch code data PD and a note duration code data LD are written in the data memory 424.

The note pitch code data PD and the note duration code data LD at such time are supplied also to the CRT display unit 412. In response thereto, the CRT display unit 412 displays on a staff 412a (FIG. 14) a note (for example a quarter note) corresponding to the designated note duration at a location (for example, at the position of "Do") corresponding to the designated note pitch.

Also, when it is intended to input a rest data, a rest length is designated by the group 416 of note duration designating keys, and also the note/rest designating switch 420*a* is turned on, and further the input instructing switch 420*b* is turned on. By so doing, the write control circuit 422 generates a note pitch code data PD whose whole bits are "0", and a note duration code data LD corresponding to the designated rest length. These data PD and LD are written in the data memory 424 in accordance with the write instruction signal WR and with the write address signal ADS which are generated based on the actuating operation of the input instructing switch 420b. In this case, the CRT display unit displays a rest corresponding to the designated rest length based on the note pitch code data PD and the note duration code data LD.

By the above-mentioned data input operation, a note/rest data enough for one tune can be written in the data memory 424. And, after completion of such a writing process, a note pitch/note duration code data may be read out as desired from the data memory 424 so that the generation of musical tone, display of the depressed key positions, display of staff, printing of staff, and so forth can be automatically accomplished.

What is claimed is:

1. A data input apparatus comprising:

an operation panel;

a plurality of course selection-designating means arranged on said operation panel each designating a coarse selection of an input instruction, respectively, from among a plurality of input instructions;

a fine adjustment designating means arranged on said operation panel common to said plurality of course selection-designating means for designating a fine adjustment to a selected one of said input instructions designated by said course selection-designating means; and a data generating means coupled to said course selection-designating means and to said fine adjustment designating means for generating data bearing information formed by said selected input instruction and said fine adjustment.

2. A data input apparatus according to claim 1 wherein:

said plurality of course selection-designating means includes a plurality of pitch keys corresponding respectively to a plurality of note names representing said input instructions to selectively designate a desired note name;

said fine adjustment designating means, when operated in conjunction with said pitch keys, designates a fine adjustment of note pitch for the designated note name; and said data generating means generates data representing a note pitch determined according to said selected note name and said fine adjustment thereof.

3. A data input apparatus according to claim 1 wherein:

said plurality of course selection-designating means includes a plurality of duration keys corresponding respectively to a plurality of note durations representing said input instructions to selectively designate a desired note duration;

said fine adjustment designating means, when operated in conjunction with said duration keys, designates a fine adjustment of time length for the designated note duration; and said data generating means generates data representing a time length determined according to said selected note duration and said fine adjustment thereof.

4. A data input apparatus according to claim 1 wherein:

said plurality of course selection-designating means includes a plurality of note attribute keys corresponding respectively to a plurality of note character control items representing said input instructions to selectively designate a desired note character control item;

said fine adjustment designating means, when operated in conjunction with said attribute keys, designates a fine adjustment of note character for the designated note character control item; and said data generating means generates data representing a note character determined according to said selected note character control item and said fine adjustment thereof.

5. A data input apparatus according to claim 1 wherein:

said plurality of course selection-designating means includes input keys provided corresponding respectively to a plurality of categories or degrees of the input instructions and a key operation detecting means for generating key operation data by detecting operated keys from among said input keys;

said fine adjustment designating means includes a touch bar which is used in common for all said input keys, display means arranged in parallel to said touch bar for indicating amounts of respective adjustments and a touch position detector for detecting a touch position on said touch bar and generating touch position data for said touch position; and said data generating means includes means for generating data bearing information determined by said key operation data and said touch position data.

6. A data input apparatus according to claim 5 wherein:

said display means includes a plurality of bar-shaped illuminable indicators respectively allotted to said categories on said degrees and provided in the vicinity of and in parallel to said touch bar, and an illuminating means for selectively illuminating such one of said bar-shaped indicators as is allotted to the category or degree of said operated key, according to said key operation data.

7. A data input apparatus according to claim 1 wherein:

said plurality of course selection-designating means includes input keys provided corresponding respectively to a plurality of categories or degrees of the input instructions and a key operation detecting means for generating key operation data by detecting operated keys from among said input keys; and said fine adjustment designating means includes a touch bar which is used in common for all said input keys.

8. A music generating device having an input apparatus according to claim 1 wherein said plurality of course selection-designating mans includes at least a plurality of musical pitch designating keys and musical duration designating keys; and said fine adjustment means includes an elongated touch means for designating a fine adjustment to the last designated course selection.

9. A data input apparatus comprising:

an operation panel;

a plurality of note pitch designating keys arranged on a right half of said operation panel for selectively designating note pitches;

a plurality of note duration designation keys arranged on a left half of said operation panel for selectively disignating note durations;

note pitch data generating means coupled to said note pitch designating keys for generating data representing the designated note pitch; and note duration data generating means coupled to said note duration designating keys for generating data representing the designated note duration;

wherein one of said note pitches may be designated while designating one of said note durations.

10. A data input apparatus according to claim 9 wherein said note pitch designating keys are arranged in an order of a fingering allotment of the musical scale notes.

11. A data input apparatus according to claim 9 wherein said note duration designating keys are formed with keytop indicia in shapes of musical notations of the given note durations, respectively.

12. A data input apparatus according to claim 9 further comprising fine adjustment means for adding a fine adjustment to the last depressed designating key.

13. A data input apparatus according to claim 12 further comprising display means for indicating which of said plurality of designating keys was last depressed.

14. A data input apparatus according to claim 12 wherein said fine adjustment means includes an adjustment bar means extending below and bridging said left and right pluralities of designating keys.

15. A data input apparatus according to claim 9 further comprising tune data memory means coupled to said note pitch data generating means and said note duration data means for storing data generated thereby.

16. A data input apparatus according to claim 9 wherein said note pitches may be designated with one hand while designating one of said note durations with another hand.

17. A data input apparatus comprising an operation panel;

a plurality of course selection keys arranged on said operation panel for generating course data;

a fine ajustment bar means arranged on said operation panel operable in common with each selected one of said course selection keys for generating fine adjustment data to be associated with the course data generated by said selected one course selection key; and an elongate display means arranged on said operation panel adjacent to said fine adjustment bar means for graphically indicating the level of said fine adjustment data relative to a predetermined adjustment range associated with said selected one course selection keys.

18. A data input apparatus according to claim 17 wherein said elongate display means includes indicia means for depicting relative values in said predetermined adjustment range with respect to the graphic indication provided by said display means.

* * * * *